US012674362B2

(12) United States Patent
Herman et al.

(10) Patent No.: US 12,674,362 B2
(45) Date of Patent: Jul. 7, 2026

(54) COMBINATION SHEAR AND GOUGING CUTTING ELEMENT AND WELL CONSTRUCTION TOOLS MADE THEREWITH

(71) Applicant: Shear Bits, Inc., Spring, TX (US)

(72) Inventors: John James Herman, Cypress County (CA); Carl M. Hoffmaster, Houston, TX (US); Felix Schweighofer, Calgary (CA)

(73) Assignee: Shear Bits, Inc., Spring, TX (US)

( * ) Notice: Subject to any disclaimer, the term of this patent is extended or adjusted under 35 U.S.C. 154(b) by 0 days.

(21) Appl. No.: 19/004,175

(22) Filed: Dec. 27, 2024

(65) Prior Publication Data

US 2025/0230712 A1 Jul. 17, 2025

Related U.S. Application Data

(63) Continuation of application No. PCT/US2023/026367, filed on Jun. 27, 2023.

(Continued)

(51) Int. Cl.
*E21B 10/567* (2006.01)
*E21B 7/28* (2006.01)

(52) U.S. Cl.
CPC ..... *E21B 10/5676* (2013.01); *E21B 7/28* (2013.01); *E21B 10/5671* (2020.05); *E21B 10/5673* (2013.01)

(58) Field of Classification Search
CPC ..... E21B 10/5673
See application file for complete search history.

(56) References Cited

U.S. PATENT DOCUMENTS 4,359,335 A * 11/1982 Garner ..... B22F 7/06 175/379
5,323,865 A * 6/1994 Isbell ..... E21B 10/16 175/420.1

(Continued)

FOREIGN PATENT DOCUMENTS

| | | | |
|---|---|---|---|
| RU | 2603308 | C1 | 2/2016 |
| WO | 2016/109110 | A1 | 7/2016 |
| WO | 2021/006912 | A1 | 1/2021 |

OTHER PUBLICATIONS

International Search Report and Written Opinion, International Application No. PCT/US2023/026367 issued Jan. 30, 2024.

*Primary Examiner* — Steven A Macdonald
(74) *Attorney, Agent, or Firm* — Richard A. Fagin

(57) ABSTRACT

A cutter for a well construction tool has a cutting structure affixed to a substrate, which defines a monotonically decreasing diameter with respect to an axial distance from an interface between the cutting structure and the substrate. A shear surface formed in the cutting structure intersects a surface of the cutting structure between the interface and an apex of the cutting structure, and defines a smaller angle with respect to a reference than the cutting structure proximate the interface and a larger angle with respect to the reference than the cutting structure proximate the apex. The apex is rotationally symmetric about a centerline of the cutting structure in all rotational directions, and a radius of curvature of the apex is at most 75 percent of a diameter of the substrate. A well construction tool includes a tool body with at least one such cutter attached to the tool body.

30 Claims, 19 Drawing Sheets

Related U.S. Application Data

(60) Provisional application No. 63/488,422, filed on Mar. 3, 2023, provisional application No. 63/356,657, filed on Jun. 29, 2022.

(56) References Cited

U.S. PATENT DOCUMENTS 5,341,890 A * 8/1994 Cawthorne ..... E21B 10/52 175/426
5,379,853 A * 1/1995 Lockwood ..... E21B 10/5673 175/428
5,592,995 A 1/1997 Scott et al.
5,706,906 A * 1/1998 Jurewicz ..... E21B 10/5673 175/428
5,752,573 A * 5/1998 Scott ..... E21B 10/16 175/430
5,819,861 A * 10/1998 Scott ..... E21B 10/567 175/371
5,881,828 A * 3/1999 Fischer ..... E21B 10/56 175/430
5,890,552 A * 4/1999 Scott ..... E21B 10/5735 175/426
5,954,147 A * 9/1999 Overstreet ..... E21B 10/567 175/433
6,059,054 A * 5/2000 Portwood ..... E21B 10/16 175/430
6,098,730 A * 8/2000 Scott ..... E21B 10/52 175/434
6,105,694 A * 8/2000 Scott ..... E21B 10/5735 175/428
6,119,798 A * 9/2000 Fischer ..... E21B 10/56 175/420.2
6,176,333 B1 * 1/2001 Doster ..... E21B 10/52 175/428
6,227,318 B1 * 5/2001 Siracki ..... E21B 10/5676 175/426
7,624,825 B2 * 12/2009 Singh ..... E21B 17/1092 175/426
7,686,106 B2 * 3/2010 Baker ..... E21B 10/50 175/430
2004/0094334 A1 * 5/2004 Singh ..... E21B 10/52 175/430
2009/0051211 A1 * 2/2009 Hall ..... E21B 10/5673 299/105
2010/0059287 A1 * 3/2010 Durairajan ..... E21B 10/5673 175/420.2
2011/0198128 A1 8/2011 McClain et al.
2012/0023833 A1 * 2/2012 Hall ..... B02C 4/305 175/414
2014/0262543 A1 * 9/2014 Stone ..... E21B 10/55 175/430
2016/0184892 A1 6/2016 Stewart et al.
2016/0186498 A1 6/2016 Herman et al.
2024/0003193 A1 * 1/2024 Song ..... C22C 29/16

* cited by examiner

COMBINATION SHEAR AND GOUGING CUTTING ELEMENT AND WELL CONSTRUCTION TOOLS MADE THEREWITH

CROSS REFERENCE TO RELATED APPLICATIONS

Continuation of International Application No. PCT/US2023/026367 filed on Jun. 27, 2023. Priority is claimed from U.S. Provisional Application No. 63/356,657 filed on Jun. 29, 2022 and U.S. Provisional Application No. 63/488,422 filed on Mar. 3, 2023.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well construction tools. More particularly, the disclosure relates to structures for cutting elements ("cutters") used in well construction tools such as drill bits, reamers and mills, and to structures for drill bits, reamers and mills using such cutters.

Well construction tools used to create, enlarge and remove obstructions from a borehole in subsurface earthen formations include various forms of cutting elements or "cutters" attached to a tool body such that axially urging and rotating the tool body causes the cutters to contact the earthen formations or material obstructions in the borehole to crush, scrape and gouge the formations and/or obstructions so that they may be removed from the borehole.

Certain types of earthen formations have been shown to be more efficiently broken and removed from boreholes using various combinations of types of cutters on the same tool body. See, for example U.S. Pat. No. 10,570,664 issued to Herman et al. A particular improvement in tool performance that may be provided by tools such as shown in the '664 patent result from the use of "gouging" cutters. Gouging cutters have a generally rotationally symmetric shape and a tip that monotonically increases in diameter with respect to axial distance from the apex of the cutter. Such shapes may include cones, such as radiused tip cones, or "ballistic" shape wherein the surface is continuously curved from a maximum diameter through the apex. Other types of cutting elements include shear cutters, which may have a substantially planar cutting surface arranged to engage the formations or obstructions at a chosen angle with respect to the direction of motion of the tool body.

A combination or hybrid form of cutter has been developed which combines features of shear cutting elements with those of gouging cutters. See, for example, U.S. Pat. No. 9,316,058 issued to Bilen et al, and U.S. Pat. No. 9,920,576 issued to Spencer.

The cutters described in the '058 and '576 patents may be improved as to their cutting performance in certain earthen formations. Thus, there is a continuing need for improved cutter configurations used in connection with well construction tools.

SUMMARY

One aspect of the present disclosure is a cutter for a well construction tool. A cutter according to this aspect has a cutting structure affixed to a substrate. The cutting structure defines a monotonically decreasing diameter with respect to an axial distance from an interface between the cutting structure and the substrate. A shear surface formed in the cutting structure intersects a surface of the cutting structure between the interface and an apex of the cutting structure, and defines a smaller angle with respect to a reference than the cutting structure proximate the interface and a larger angle with respect to the reference than the cutting structure proximate the apex. The apex is rotationally symmetric about a centerline of the cutting structure in all rotational directions, and a radius of curvature of the apex is at most 75 percent of a diameter of the substrate.

In some embodiments, the radius of curvature of the apex is at most 50 percent of the diameter of the substrate.

In some embodiments, the radius of curvature of the apex is at most 25 percent of the diameter of the substrate.

In some embodiments, the shear surface comprises a first planar subsurface intersecting the cutting structure proximate the apex. The first planar subsurface is oriented at the larger angle. The shear surface comprises a second planar subsurface intersecting the cutting structure proximate the interface. The second planar subsurface is oriented at the smaller angle.

Some embodiments further comprise a chip breaker feature intermediate an intersection of the first planar subsurface with the cutting structure and intersection of the second planar subsurface with the cutting structure. The chip breaker feature is disposed intermediate lateral intersections of the first planar subsurface with the cutting structure and intermediate lateral intersections of the second planar subsurface with the cutting structure. The chip breaker feature extends outwardly from the first planar subsurface and the second planar subsurface.

In some embodiments, an amount of outward extension of the chip breaker feature is related to a distance away from the lateral intersection of the first planar subsurface and the second planar subsurface with the cutting structure on one side of a laterally intermediate point on the chip breaker feature, and is related to the distance away from the lateral intersection of the first planar subsurface and the second planar subsurface on an opposed side of the intermediate point.

In some embodiments, the intermediate point is mid way between opposed lateral intersections of the first planar subsurface and the second planar subsurface.

Some embodiments further comprise at least one flow channel formed in the cutting structure between the apex and the interface on opposed lateral flanks of the cutting structure. The at least one flow channel has a radius of curvature and depth of cut so as to intersect each lateral flank at less than a full diameter of the cutting structure at a respective longitudinal position along the centerline of the cutting structure.

In some embodiments, the at least one flow channel on the opposed lateral flanks subtends an oblique angle with respect to the centerline.

In some embodiments, the subtended oblique angle corresponds to an angle subtended between the centerline and an axis of rotation of a tool body to which the cutter is attached.

Another aspect of the present disclosure is a cutter for a well construction tool. A cutter according to this aspect comprises a cutting structure affixed to a substrate. The cutting structure defines a monotonically decreasing diameter with respect to an axial distance from an interface between the cutting structure and the substrate. The cutting structure has at least two shear surfaces formed in the cutting structure. Each shear surface intersects a surface of the cutting structure between the interface and an apex of the cutting structure. Each shear surface defines a smaller angle with respect to a reference than the cutting structure proximate the interface, and defines a larger angle with respect to the reference than the cutting structure proximate the apex. A plane of symmetry of one of the at least two shear cutters subtends and angle with respect to a plane of symmetry of another one of the at least two shear surfaces of less than 180 degrees.

In some embodiments, a radius of curvature of the apex is at most 75 percent of a diameter of the substrate.

In some embodiments, a radius of curvature of the apex is at most 50 percent of the diameter of the substrate.

In some embodiments, a radius of curvature is at most 25 percent of the diameter of the substrate.

In another aspect, the present disclosure provides a well construction tool having a tool body and at least one cutter attached to the tool body. The at least one cutter has a cutting structure affixed to a substrate, which defines a monotonically decreasing diameter with respect to an axial distance from an interface between the cutting structure and the substrate. A shear surface formed in the cutting structure intersects a surface of the cutting structure between the interface and an apex of the cutting structure, and defines a smaller angle with respect to a reference than the cutting structure proximate the interface and a larger angle with respect to the reference than the cutting structure proximate the apex. The apex is rotationally symmetric about a centerline of the cutting structure in all rotational directions, and a radius of curvature of the apex is at most 75 percent of a diameter of the substrate.

In some embodiments, the tool body comprises one of a drill bit body, a reaming tool body and a mill body.

In some embodiments, the radius of curvature of the apex is at most 50 percent of the diameter of the substrate.

In some embodiments, the radius of curvature is at most 25 percent of the diameter of the substrate.

In some embodiments, at least a second one of the plurality of cutters comprises a shear cutter.

In some embodiments, the at least one of the plurality of cutters is mounted to a post formed in the tool body.

In some embodiments, the at least one of the plurality of cutters is mounted to a blade formed in the tool body.

In some embodiments, the shear surface comprises a first planar subsurface intersecting the cutting structure proximate the apex. The first planar subsurface is oriented at the larger angle. The shear surface comprises a second planar subsurface intersecting the cutting structure proximate the interface. The second planar subsurface is oriented at the smaller angle.

Some embodiments further comprise a chip breaker feature intermediate intersection of the first planar subsurface with the cutting structure and intersection of the second planar subsurface with the cutting structure. The chip breaker feature is disposed intermediate lateral intersections of the first planar subsurface with the cutting structure and intermediate lateral intersections of the second planar subsurface with the cutting structure. The chip breaker feature extends outwardly from the first planar subsurface and the second planar subsurface.

In some embodiments, an amount of outward extension of the chip breaker feature is related to a distance away from the lateral intersection of the first planar subsurface and the second planar subsurface on one side of a laterally intermediate point, and is related to the distance away from the lateral intersection of the first planar subsurface and the second planar subsurface on an opposed side of the intermediate point.

In some embodiments, the intermediate point is mid way between opposed lateral intersections of the first planar subsurface and the second planar subsurface.

Some embodiments further comprise at least one flow channel formed in the cutting structure between the apex and the interface on opposed lateral flanks of the cutting structure, the at least one flow channel having a radius of curvature and depth of cut so as to intersect each lateral flank at less than a full diameter of the cutting structure at a respective longitudinal position along the centerline of the cutting structure.

In some embodiments, the at least one flow channel on the opposed lateral flanks subtends an oblique angle with respect to the centerline.

In some embodiments, the subtended angle corresponds to an angle subtended between the centerline and an axis of rotation of a tool body to which the cutter is attached.

In another aspect, the present disclosure provides a well construction tool. A well construction tool according to this aspect includes a tool body and at least one cutter attached to the tool body. The at least one cutter has a cutting structure affixed to a substrate. The cutting structure defines a monotonically decreasing diameter with respect to an axial distance from an interface between the cutting structure and the substrate, and at least two shear surfaces formed in the cutting structure. Each shear surface intersects a surface of the cutting structure between the interface and an apex of the cutting structure. Each shear surface defines a smaller angle with respect to a reference than the cutting structure proximate the interface. Each shear surface defines a larger angle with respect to the reference than the cutting structure proximate the apex. A plane of symmetry of one of the at least two shear surfaces subtends and angle with respect to a plane of symmetry of another one of the at least two shear surfaces of less than 180 degrees.

In some embodiments, a radius of curvature of the apex is at most 75 percent of a diameter of the substrate.

In some embodiments, a radius of curvature of the apex is at most 50 percent of the diameter of the substrate.

In some embodiments, a radius of curvature is at most 25 percent of the diameter of the substrate.

In some embodiments, at least a second one of the plurality of cutters comprises a shear cutter.

In some embodiments, the at least one of the plurality of cutters is mounted to a post formed in the tool body.

In some embodiments, the at least one of the plurality of cutters is mounted to a blade formed in the tool body.

In some embodiments, the plane of symmetry of the one of the at least two shear surfaces and the plane of symmetry of the other one of the at least two shear surfaces are oriented at least in part along a direction of motion of the at least one cutter as the at least one of the plurality of cutters is attached to the tool body.

A cutter for a well construction tool according to another aspect of the present disclosure includes a cutting structure affixed to a substrate. The cutting structure defines a monotonically decreasing diameter with respect to an axial distance from an interface between the cutting structure and the substrate to an apex of the cutting structure. The cutting structure includes at least one flow channel formed in the cutting structure between the apex and the interface on opposed lateral flanks of the cutting structure. The at least one flow channel has a radius of curvature and depth of cut so as to intersect each lateral flank at less than a full diameter of the cutting structure at a respective longitudinal position along a centerline of the cutting structure.

In some embodiments, the at least one flow channel on the opposed lateral flanks subtends an oblique angle with respect to the centerline of the cutting structure.

In some embodiments, the subtended angle corresponds to an angle subtended between the centerline and an axis of rotation of a tool body to which the cutter is attached.

Some embodiments further comprise a chip breaker feature intermediate intersection of a first planar subsurface on a shear surface intersecting the cutting structure between the apex and the interface, and a second planar subsurface on the shear surface intersecting the cutting structure between the first planar subsurface and the interface. The chip breaker feature is disposed intermediate lateral intersections of the first planar subsurface with the cutting structure and intermediate lateral intersections of the second planar subsurface with the cutting structure. The chip breaker feature extends outwardly from the first planar subsurface and the second planar subsurface.

In some embodiments, an amount of outward extension of the chip breaker feature is related to a distance away from the lateral intersection of the first planar subsurface and the second planar subsurface on one side of a laterally intermediate point and a distance away from the lateral intersection of the first planar subsurface and the second planar subsurface on an opposed side of the intermediate point.

In some embodiments, the intermediate point is mid way between opposed lateral intersections of the first planar subsurface and the second planar subsurface.

A well construction tool according to another aspect of the present disclosure includes a tool body, and a plurality of cutters attached to the tool body. At least one of the plurality of cutters comprises a cutting structure affixed to a substrate. The cutting structure defines a monotonically decreasing diameter with respect to an axial distance from an interface between the cutting structure and the substrate to an apex of the cutting structure, and there is at least one flow channel formed in the cutting structure between the apex and the interface on opposed lateral flanks of the cutting structure. The at least one flow channel has a radius of curvature and depth of cut so as to intersect each lateral flank at less than a full diameter of the cutting structure at a respective longitudinal position along a centerline of the cutting structure.

In some embodiments, the tool body comprises one of a drill bit body, a reaming tool body and a mill body.

In some embodiments, a radius of curvature of the apex is at most 50 percent of a diameter of the substrate.

In some embodiments, the radius of curvature is at most 25 percent of the diameter of the substrate.

In some embodiments, at least a second one of the plurality of cutters comprises a shear cutter.

In some embodiments, the at least one of the plurality of cutters is mounted to a post formed in the tool body.

In some embodiments, the at least one of the plurality of cutters is mounted to a blade formed in the tool body.

In some embodiments, a plane of symmetry of the at least one cutter is oriented parallel to a direction of rotation of the well construction tool during use.

In some embodiments, the plane of symmetry is parallel to the at least one flow channel.

In some embodiments, the at least one flow channel on the opposed lateral flanks subtends an oblique angle with respect to a centerline of the at least one cutter.

In some embodiments, the subtended angle corresponds to an angle subtended between the centerline of the at least one cutter and an axis of rotation of the tool body.

Other aspects and possible advantages will be apparent from the description and claims that follow.

DETAILED DESCRIPTION

Figure 1:
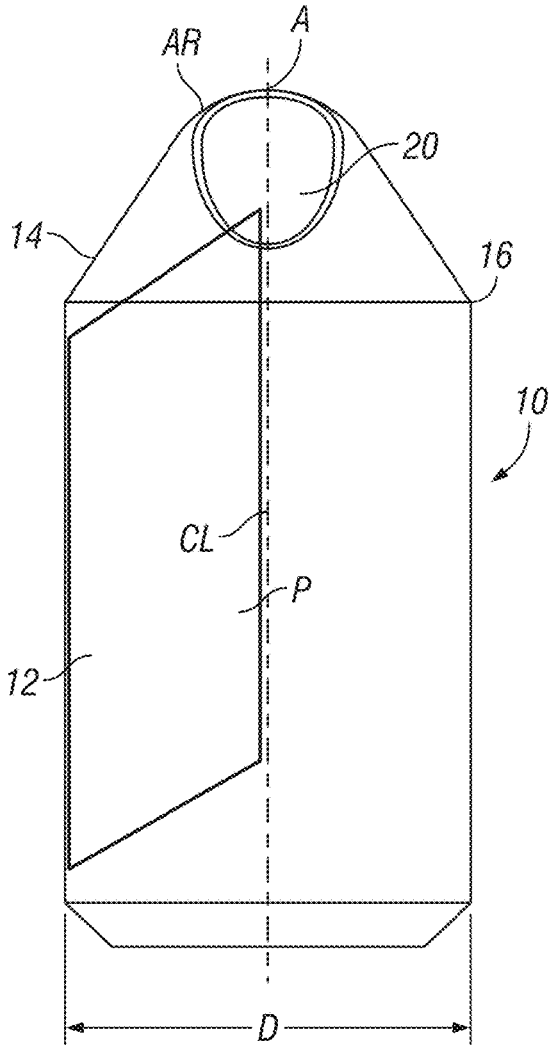
FIG. 1 shows a side elevation view of an example embodiments of a cutting element (cutter) according to the present disclosure.

Cutting element structures according to the present disclosure may be used in any form of well construction tool used for drilling, reaming or boring of subsurface wells, for example and without limitation, drill bits, reamers and mills. As will be appreciated by those skilled in the art, and without limiting the generality of the foregoing, drill bits are used to create a borehole in subsurface earthen formations. Reamers are used to enlarge the diameter of an already drilled borehole. Mills are used to remove obstructions from a borehole or to create openings in various devices disposed in a borehole. The foregoing described embodiments are provided only as examples and are not intended in any way to limit the scope of well construction tools to which cutting structures according to the present disclosure may be used, nor to limit uses for specifically described well construction tools.

In the description that follows, reference will be made to various drawing figures. It should be noted that like reference numerals used in different drawing figures represent like components or elements among the various drawing figures.

An example of a cutting element (hereinafter a "cutter") 10 according to the present disclosure for a well construction tool is shown in side elevation view in FIG. 1 and such view is shown rotated 90 degrees in FIG. 2. The cutter 10 may be described as a "combination cutter" for convenience herein because its interaction with earthen formations includes crushing the formations to cause fracturing. and then shearing the fractured formations to remove them from the bottom and sides of the borehole (in the case of drill bits). The combination cutter 10 may comprise a structural member called a substrate 12, for example a cylindrically shaped body made from a hard material such as tungsten carbide, other metal carbide, or steel covered with a layer of such hard material, e.g., a metal carbide. The substrate 12 is the part of the combination cutter 10 that attaches to a tool body when the disclosed combination cutter forms part of a well construction tool. The substrate 12 may have disposed on one longitudinal end a cutting structure 14. Attachment of the combination cutter 10 to the tool body (explained further below) may be made by any known manner of attachment, including without limitation interference fit, welding, brazing, set screws or locking rings. The substrate 12 may be cylindrically shaped, for example, and define a diameter D.

The cutting structure 14 may be made from superhard material such as polycrystalline diamond (PCD), diamond monolith, cubic boron nitride (CBN), diamond impregnated carbide, other diamond impregnated alloy or other superhard material known in the art for use as a cutting structure in well construction tools such as drill bits, reamers and mills. In general, the material used for the cutting structure 14 may be a harder material than that used to make or cover the substrate 12. An interface 16 between the substrate 12 and the cutting structure 14 may be planar or other shape as is known to be used to form an attachment surface for mounting a superhard cutting structure onto the substrate of a cutter.

The cutting structure 14 according to the present disclosure may be in the shape of a cone or any other rotationally symmetric shape that monotonically decreases in diameter with respect to axial distance away from the interface 16. "Rotationally symmetric" as used herein means symmetry about a center line CL of the cutting structure 14 in all directions from the center line CL. Such symmetry is subject to the shape of an included shear surface formed on the cutting structure 14, to be explained further below. The cutting structure 14 may define a flank 14A and a tip 14B. The flank 14A may be, for example, substantially linear along a tangent to its exterior surface from the interface 16 to the beginning of the tip 14B, although the scope of the present disclosure is not so limited. The tip 14B may be radiused (and thereby define a radius of curvature AR) about an apex A. Thus, the flank 14A may in some embodiments define a first angle 21A with respect to a fixed reference H, e.g., a horizontal plane, at the interface 16. "Horizontal" in the present context means perpendicular to the center line CL. The tip 14B may define some or all angles in a range between the first angle 21A and a line parallel to the fixed reference H (such line being defined herein as zero angle). Such range of angles may be continuous from the first angle 21A, through zero at the apex A and back to the first angle 21A, if a boundary 14C between the flank 14A and the tip 14B does not define a step change in angle with respect to the flank 14A. Such range of angles, on the other hand, may be discontinuous if the surface of the tip 14B at the boundary 14C has a different angle, e.g., at 23A than the angle of the flank 14A at the boundary 14C.

The apex A may define a radius of curvature AR as previously stated. It has been determined that improved performance of combination cutters made according to the present disclosure may be obtained by limiting the radius of curvature AR to at most 75% of the diameter D of the substrate 12. In some embodiments, the radius of curvature AR may be at most 50% of the diameter D of the substrate 12. In some embodiments, the radius of curvature AR may be at most 25% of the diameter D of the substrate 12.

It is to be clearly understood that the exterior surface profile of the flank 14A and the tip 14B are not limited to any specific form; it is only required that the flank 14A and the tip 14B define the ranges of angles and radius of curvature AR as described herein. In some embodiments, the tip 14B may define a relatively small diameter contact area 14B-1 having a radiused profile. The tip 14B in a cutter according to the present disclosure is intended to break through earthen formations and other materials by the action of compressing the formations or other materials beyond their compressive strength, in a manner similar to well-known cutting structures ("teeth") used in roller cone drill bits. Thus, a relatively small contact area 14B-1 may be useful in obtaining such tool performance because the pressure exerted by the contact area 14B-1 is inversely related to the size of the contact area 14B-1 at any specific axial force applied to the combination cutter 10.

The tip 14B may be rotationally symmetric in all rotational directions about the center line CL, thus providing that the tip 14B at all diameters defines a circular cross-section, subject to inclusion of a shear surface in the cutting structure 14 to be explained further below.

The cutting structure 14, as stated above, may define a shear surface 20 on its exterior. The shear surface 20 may define any surface shape, e.g., planar, curved, dished or other shape feature formed in the exterior surface of the cutting structure 14. Irrespective of the particular shape itself, the shape of the shear surface 20 interrupts the rotationally symmetric shape of the cutting structure 14, and the shear surface 20 may have the following properties. The shear surface 20 defines a greater angle 23, with respect to the reference H, where the shear surface 20 terminates proximate the tip 14B than the angle 23A defined by the tip 14B with respect to the reference H at such termination. The shear surface 20 defines a smaller angle 21 with respect to the reference H than the angle 21A defined by the flank 14A at the termination of the shear surface 20 proximate or on the flank 14A. The foregoing terminations define the longitudinal extent of the shear surface 20 along the cutting structure 14. A lateral extent of the shear surface 20, the significance of which will be described below, is perpendicular to the longitudinal extent of the shear surface 20.

Thus, the shear surface 20 terminates proximate the apex A but does not cross the apex A with respect to the center line CL. The shear surface 20 terminates proximate the interface 16 but does not cross the interface 16. The shear surface 20 may be formed in any known manner, for example and without limitation, electrode discharge machining (EDM) material from the cutting structure 14. In some embodiments, the shear surface 20 may be planar or, for example, may be concave (dish shaped) viewed from above the cutting structure 14. The specific shape of the shear surface 20 is not intended to limit the scope of the present disclosure; the only limitation on the shape of the shear surface 20 is that it does not cross the apex A or the interface 16. Thus, all of the shear surface 20 is disposed within the cutting structure 14 on one side of the center line CL. One side as used herein means on one side of a plane bisecting the cutting structure 14 through the center line CL.

In some embodiments, the shear surface 20 may define a plane of symmetry P. The plane of symmetry P may be defined as the intersection of a plane passing through the both the center line CL and the lateral center (the midpoint of the lateral extent) of the shear surface 20. The plane of symmetry P may be used, as will be explained further below, to define an orientation of the combination cutter 10 as to its attachment on a well tool. In some embodiments, the orientation defined by the plane of symmetry P may be within a predetermined angular range with reference to the direction of rotation of a well construction tool (explained further below) during use.

Figure 2:
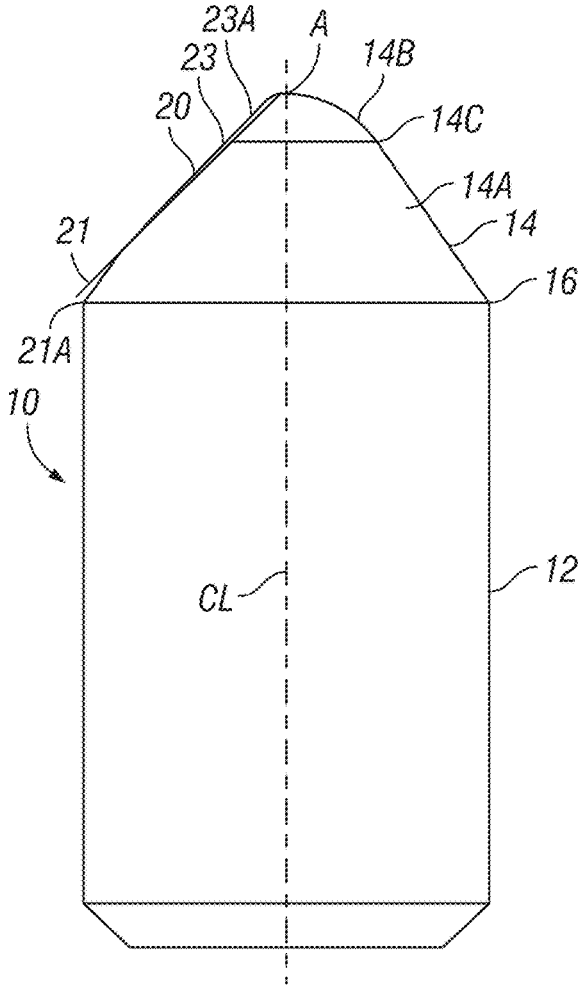
FIG. 2 shows a view of the cutter of FIG. 1 rotated 90 degrees with respect to the view in FIG. 1.
Figure 3:
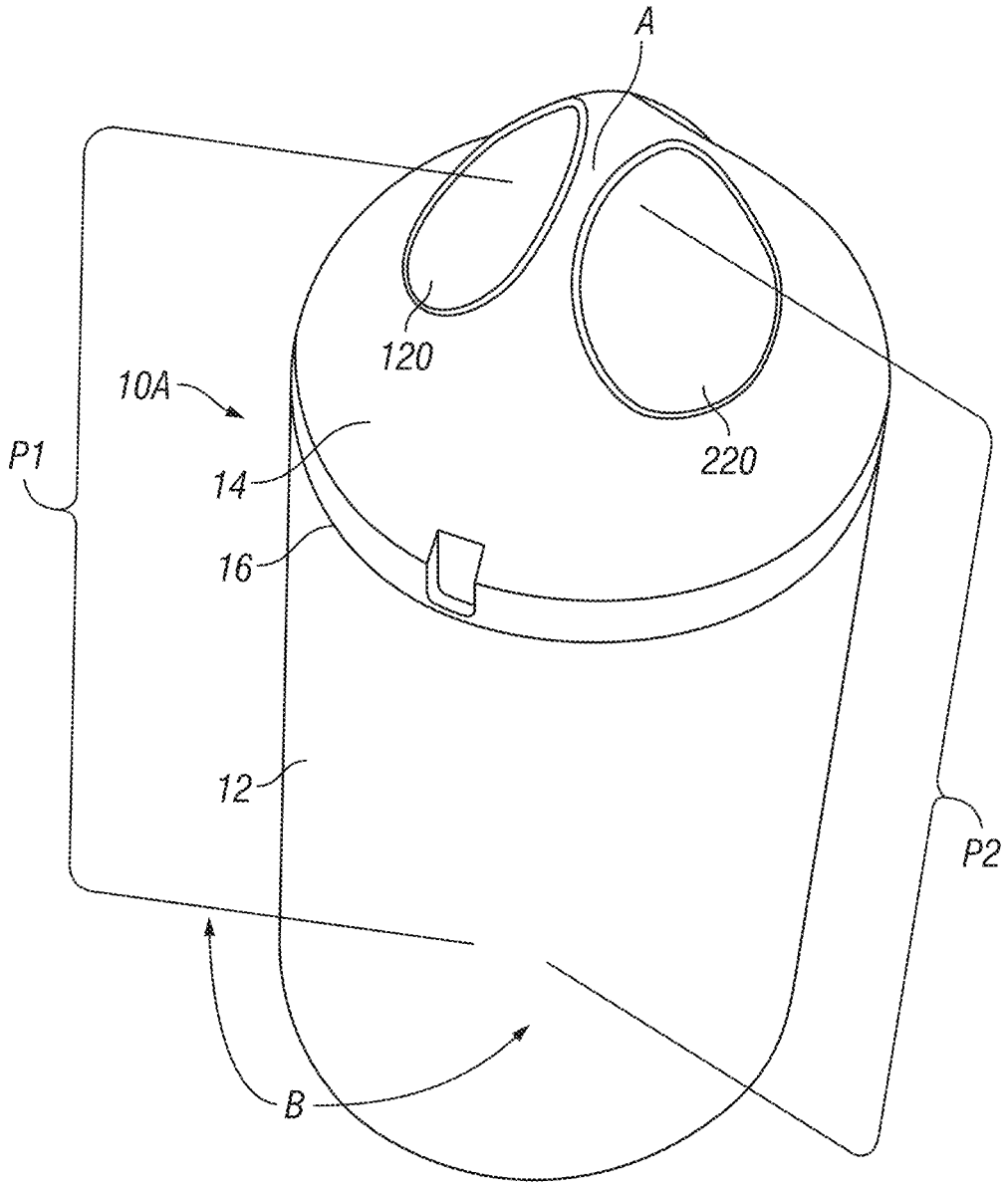
FIG. 3 shows an oblique view of an example embodiment of a cutter according to the present disclosure.

FIG. 3 shows another example embodiment of a combination cutter according to the present disclosure. The combination cutter 10A may comprise all the features of the combination cutter explained with reference to FIGS. 1 and 2, including a cutting structure 14 disposed on a substrate 12, wherein an interface 16 divides the cutting structure 14 from the substrate 12. In the present example embodiment, the cutting structure 14 may comprise two shear surfaces, shown at 120 and 220, respectively. Each of the two shear surfaces 120, 220 may have similar structural features to the shear surface explained with reference to FIGS. 1 and 2. Each shear surface 120, 220 may define a plane of symmetry P1, P2, respectively. The planes of symmetry P1, P2 may be separated by any angle B greater than zero and less than 180 degrees. Various example embodiments of well construction tools to be explained further below may include embodiments of a combination cutter as explained with reference to FIGS. 1 and 2, and/or with reference to FIG. 3.

Figure 4:
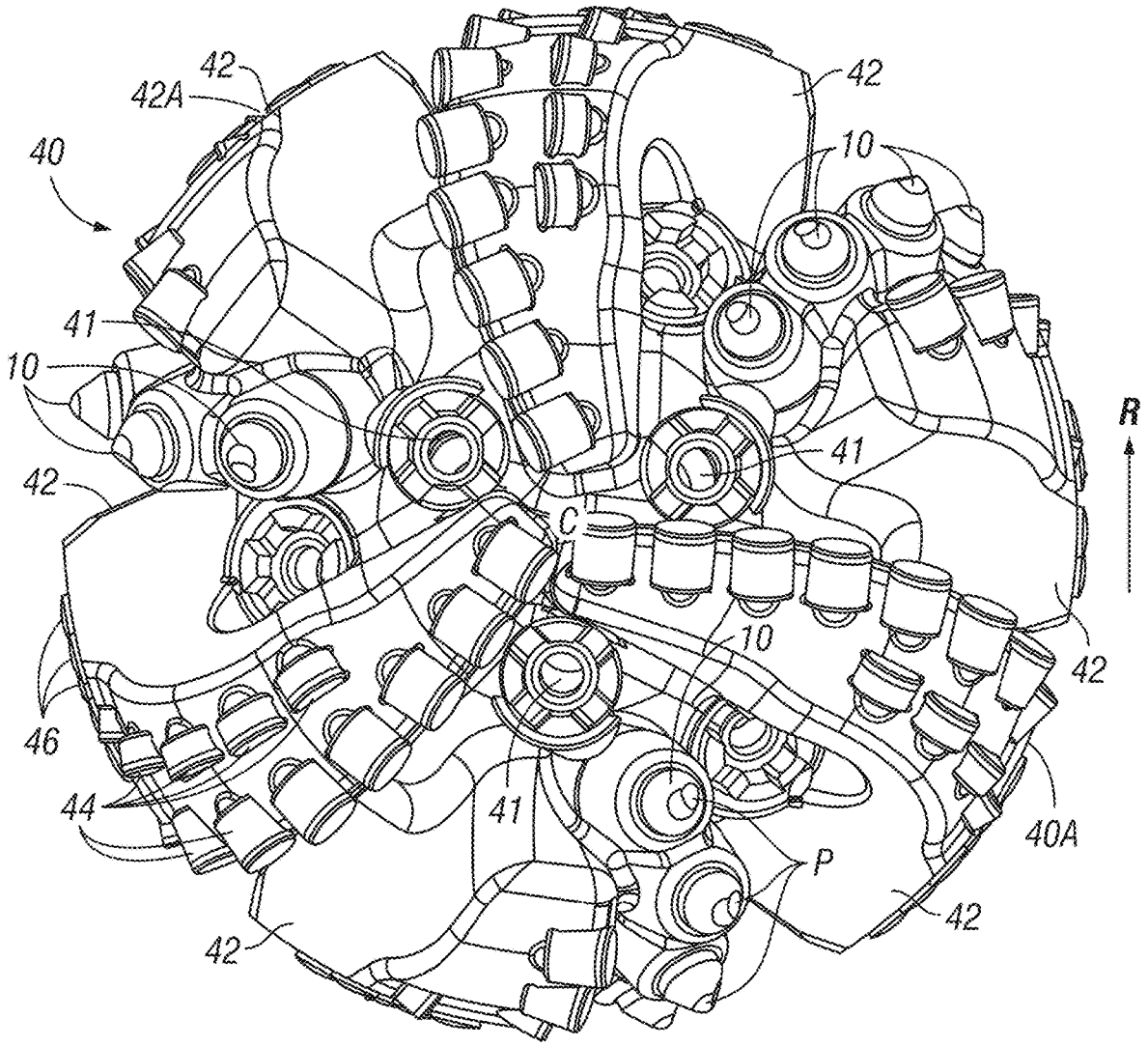
FIG. 4 shows an end view of a drill bit having cutters according to the present disclosure.
Figure 5:
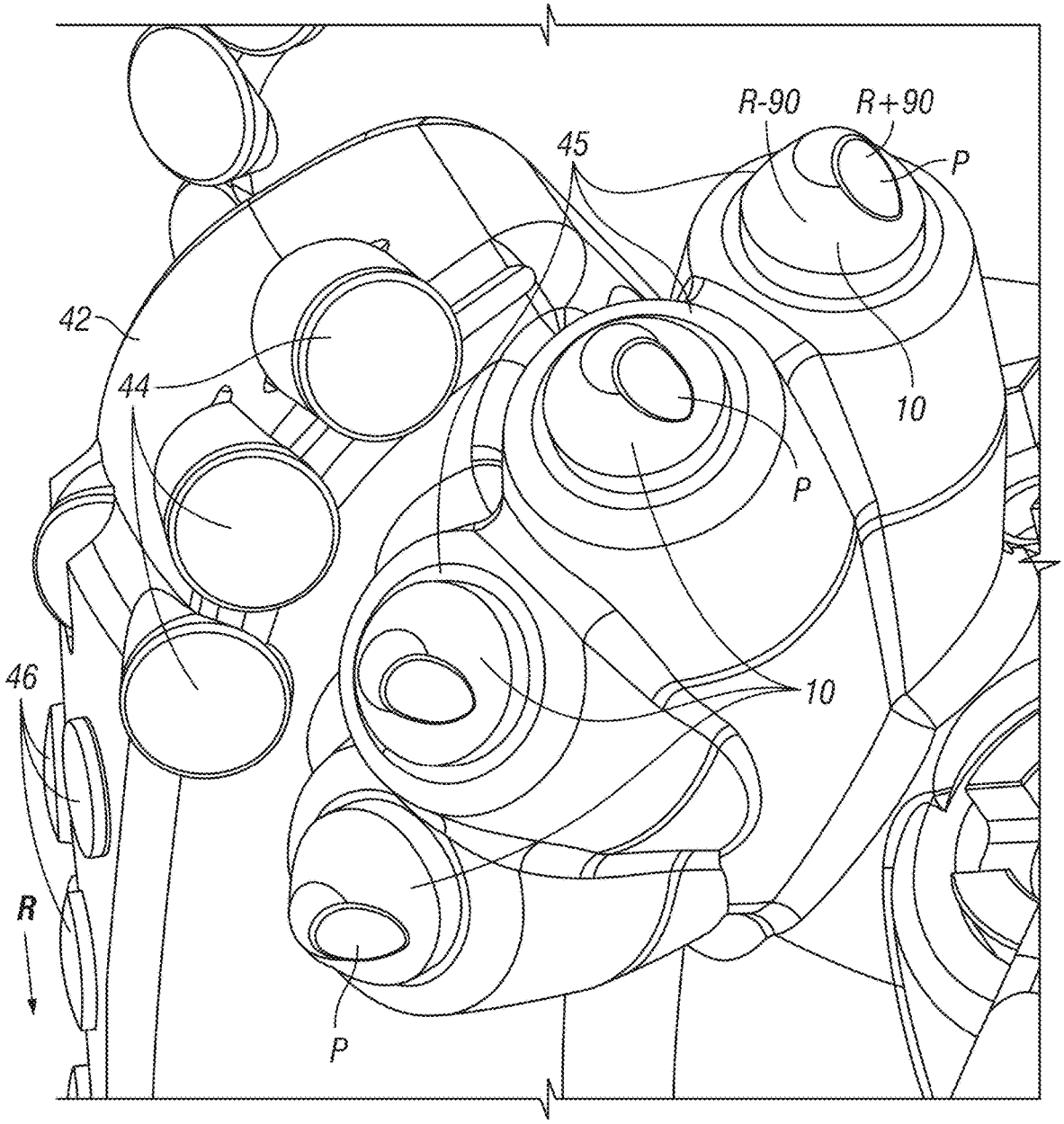
FIG. 5 shows an enlarged view of one of the blades on the drill bit of FIG. 4.

FIG. 4 shows an end view of a well construction tool, specifically, a drill bit 40, made using combination shear and gouging cutters as explained herein with reference to any of FIGS. 1, 2 and 3. An expanded view of part of the structure of the drill bit 40 is shown in FIG. 5. The drill bit 40 may comprise a bit body 40A formed using any materials and geometric configurations known in the art for subsurface well drill bits. In the present example embodiments, the bit body 40A may comprise a plurality of circumferentially spaced apart bleads 42, each of which may extend from a position proximate of a predetermined distance from a center of rotation CL of the bit body 40A out to a gage surface 42A. Any one or more of the blades 42 may comprise gage inserts, pads or cutters 46 (see FIG. 5). The bit body 40A may comprise one or more nozzles or jets 41 through which passes drilling fluid during well construction operations to cool and lubricate the drill bit 40, and to remove drill cuttings from the well in a manner known in the art.

Other cutters 44, for example shear cutters, may be disposed on or about any one or more of the blades 42 in a pattern that defines a bit cutting profile. One or more combination cutters 10 (10 from FIGS. 1 and 2, or at 10A in FIG. 3) formed as explained previously herein, may be attached to the bit body 40A on mounting pockets or posts 45 formed in the bit body 40A for the purpose of mounting cutters. The number of and placement of the combination cutters 10 (or 10A) is a matter of discretion for the tool designer or user; for purposes of defining the scope of the present disclosure at least one such combination cutter may be used on any particular well construction tool. Furthermore, well construction tools according to the present disclosure are not limited as to the type or number of such other cutters 44.

The plane (or planes) of symmetry P in each of the combination cutters 10 (or 10A) may be oriented within an arc having limits defined by the direction of rotation of the drill bit, shown at R plus 90 degrees, and the direction of rotation R minus 90 degrees as shown in FIG. 5. Thus, the plane of symmetry P for each combination cutter 10 will have some component of its direction along the direction of motion R. The direction of rotation R may be conventional rotation, that is, counterclockwise from the perspective of the cutting end of the drill bit 40 as shown in FIG. 4 and FIG. 5. It will be appreciated by those skilled in the art that the direction of rotation R at any point along the construction tool (e.g., drill bit 40) is defined as perpendicular to a line connecting such point and the center of rotation C of the well construction tool.

In embodiments that use one or more of the two-shear-surface cutters (10A in FIG. 3) as explained with reference to FIG. 3, the planes of symmetry (P1 and P2 in FIG. 3) are oriented such that both planes of symmetry have at least some component of their direction along the direction of rotation R, that is, both planes of symmetry P1, P2 are within the limits R+90 and R−90.

Figure 6:
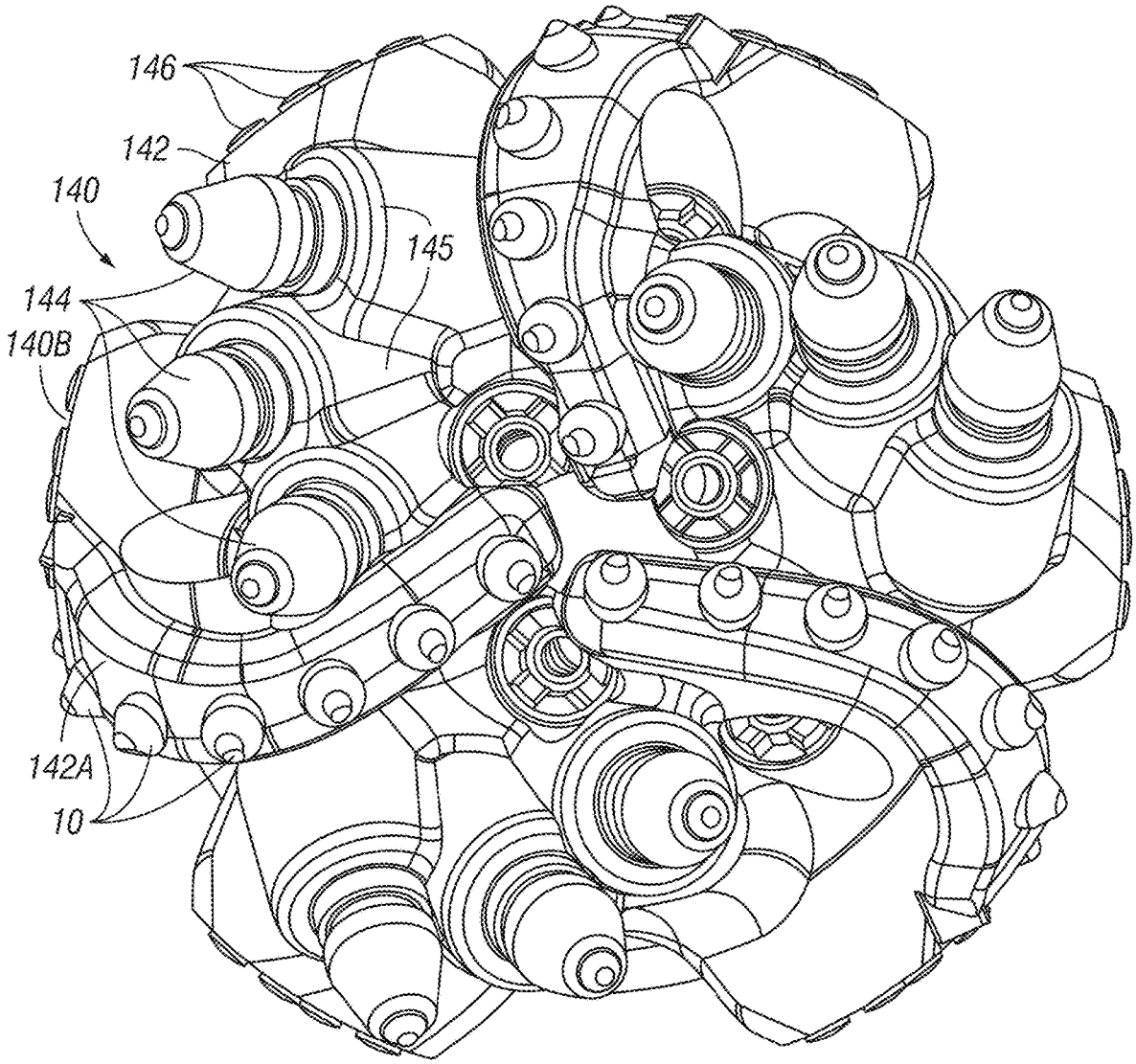
FIGS. 6 and 7 show views corresponding to FIGS. 4 and 5, respectively, of an example embodiment of a drill bit according to the present disclosure.
Figure 7:
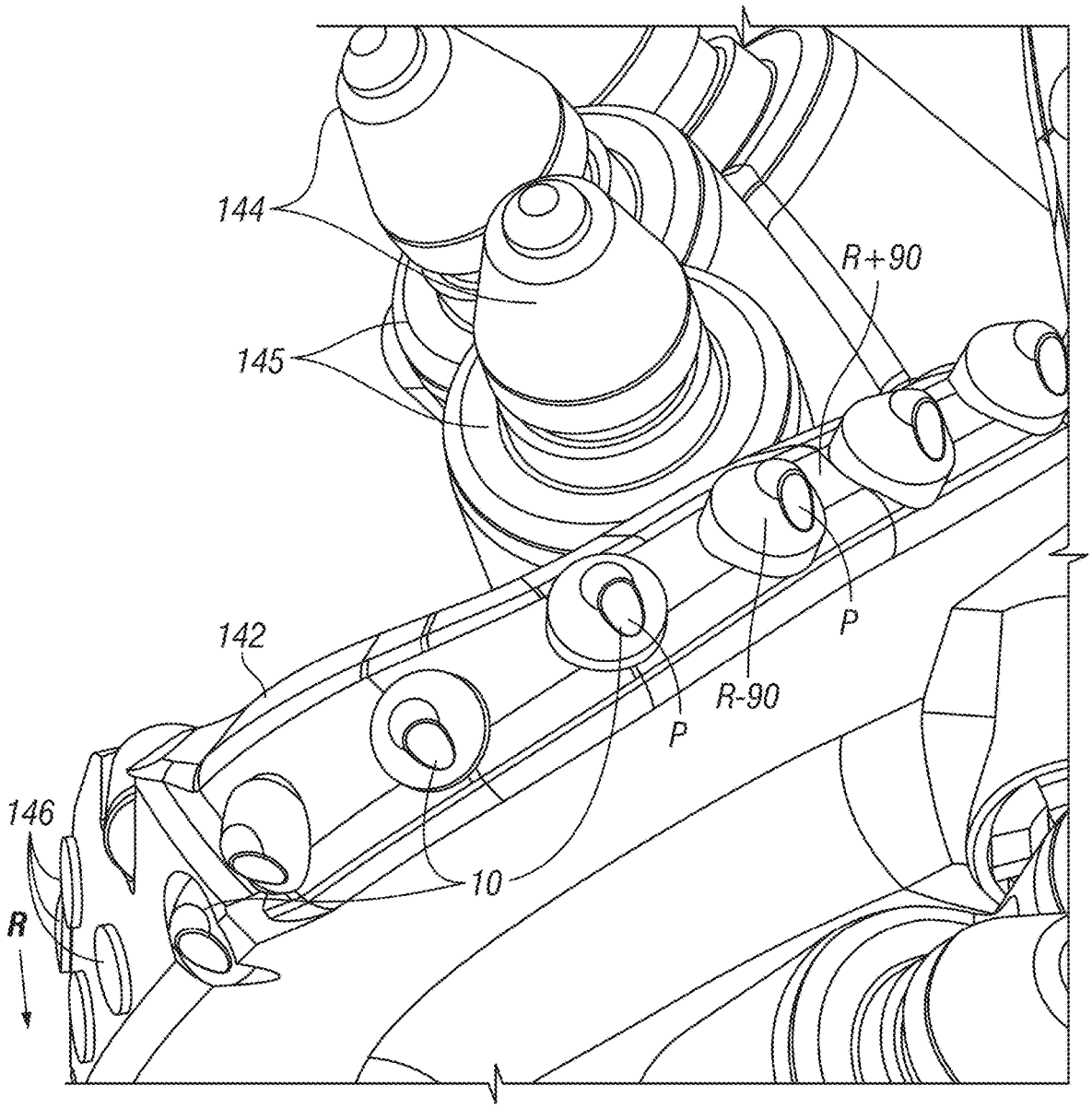

FIGS. 6 and 7 show views corresponding to those of FIGS. 4 and 5, respectively of another example embodiment of a drill bit 140. The drill bit 140 may comprise a bit body 140A as explained with reference to FIGS. 4 and 5. The bit body 140A may comprise one or more generally radially extending blades 142 that may terminate in a gage surface 140B. In some embodiments, the gage surface 140B may comprise gage inserts, pads or cutters 146 of types known in the art. The one or more blades 142 may define an axial limit referred to as a "blade top" 142A. Cutters may be mounted on the blade top 142A. In the present example embodiment, the cutters mounted on the blade top 142A may be the combination cutters 10 (or 10A) as described with reference to any of FIGS. 1 through 3. The combination cutters 10 may be oriented such that their planes of symmetry P are oriented within a range of between 90 degrees ahead of, R+90, and 90 degrees behind, R−90, of the direction of rotation R. The drill bit 140 may comprise, in addition to the combination cutters 10, other cutters 144, for example, gouging cutters as described in U.S. Pat. No. 10,107,041 issued to Herman et al. In some embodiments, such other cutters 144 may be mounted to the bit body 140B in or on pockets or posts 145 separate from any of the blades 142.

Figure 8:
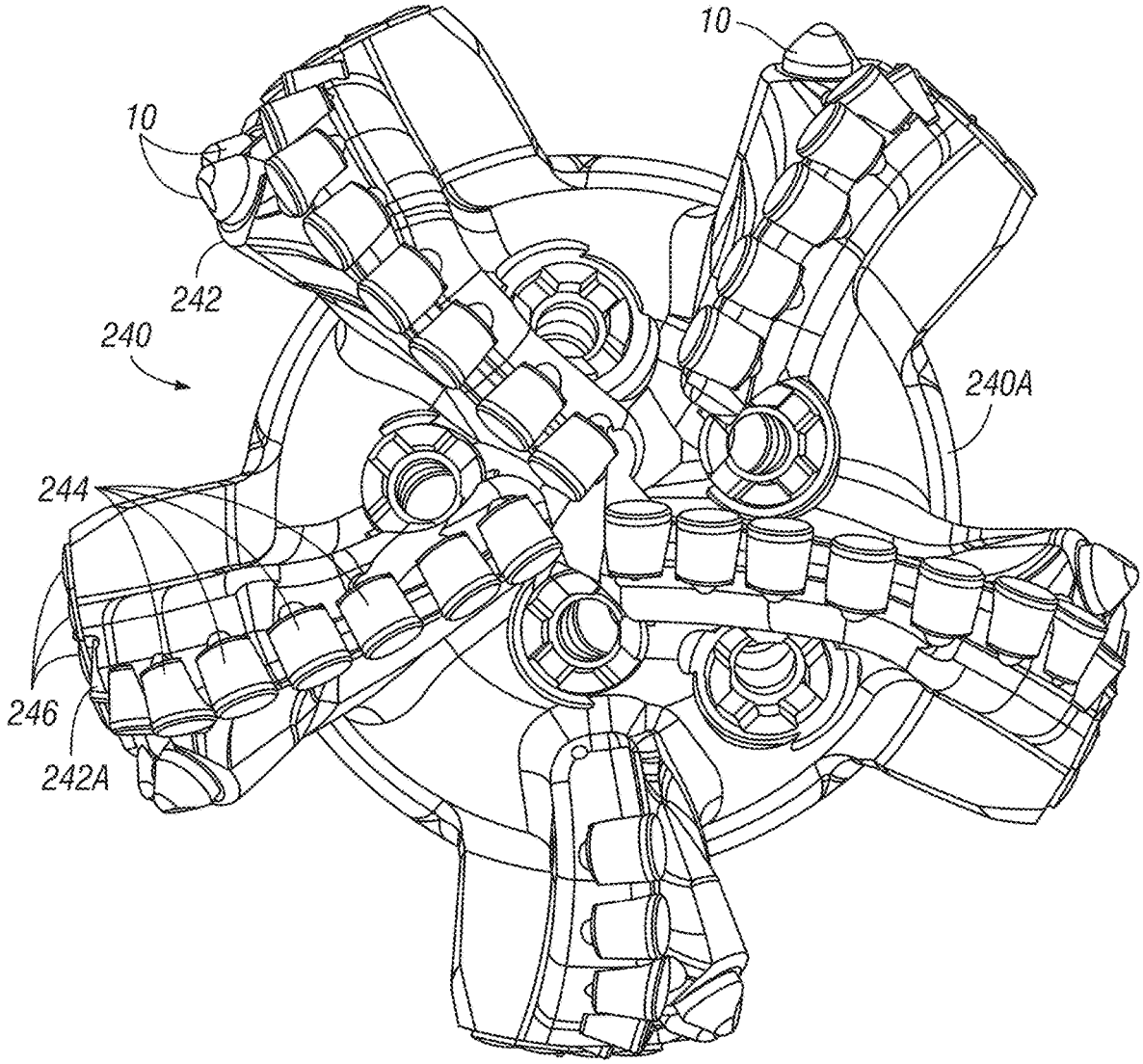
FIGS. 8 and 9 show views corresponding to FIGS. 4 and 5, respectively, of an example embodiment of a drill bit according to the present disclosure.
Figure 9:
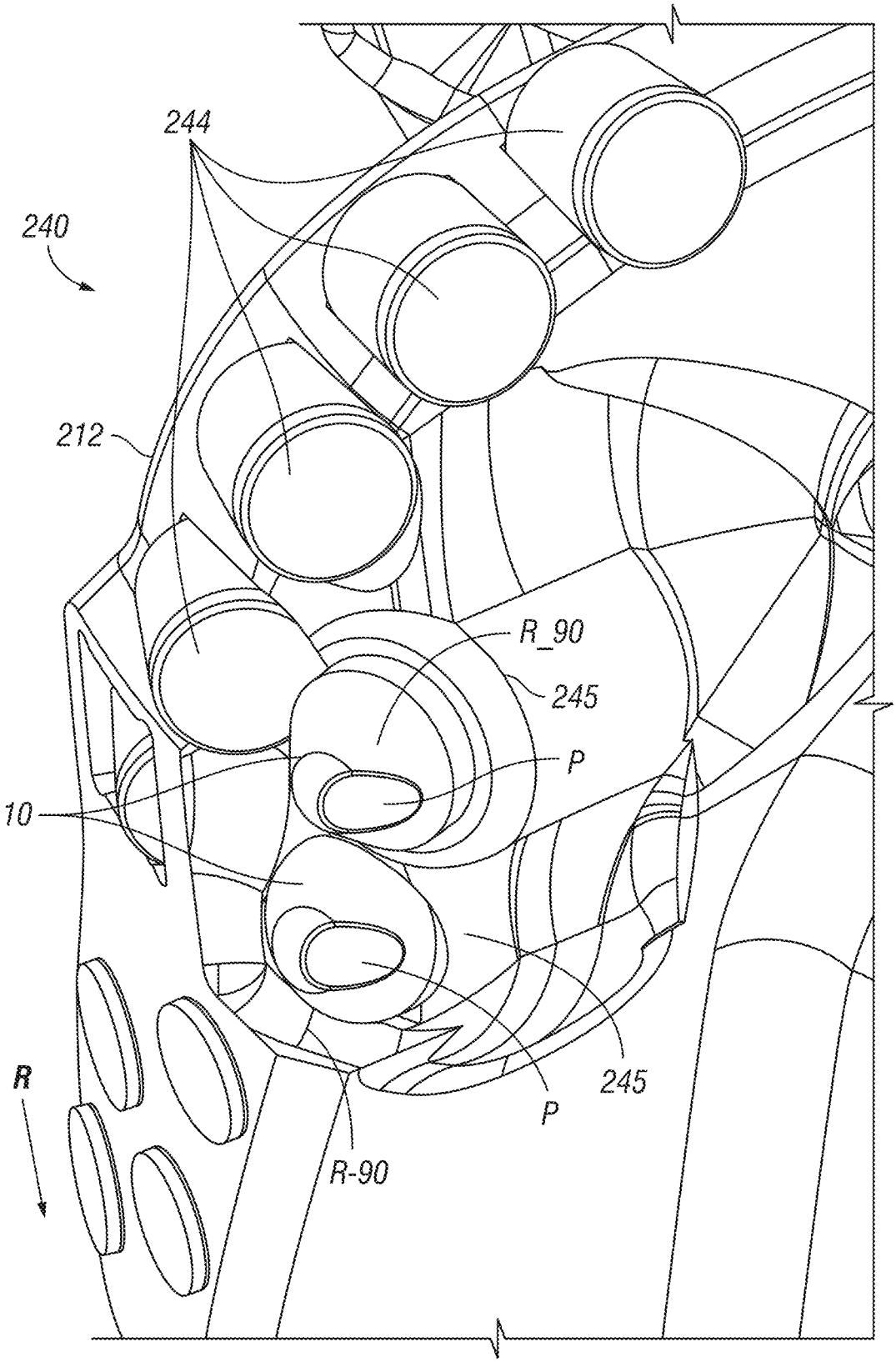

FIGS. 8 and 9 show views corresponding to the views of FIGS. 4 and 5 of another example embodiment of a drill bit 240 according to the present disclosure. The drill bit 240 may comprise a bit body 240A made as explained above. The bit body 240A may comprise one or more generally radially extending blades 242, some or all of such blades 242 having a gage surface 242A. In some embodiments, gage pads, gage inserts or gage cutters 246 may be affixed to the gage surface 242A. The blade(s) 242 may have mounted thereon proximate the blade top, other cutters 244, for example, shear cutters. Combination cutters 10 as explained with reference to FIGS. 1 through 3 may be mounted to post structures rotationally ahead of the blade top proximate to the gage surface 242A, that is, radially outboard of the other cutters 244. The combination cutters 10 may be mounted such that their planes of symmetry P are oriented between the limits shown as R+90 and R−90 as in the previously described embodiments with reference to the direction of rotation R of the drill bit 240.

Figure 10:
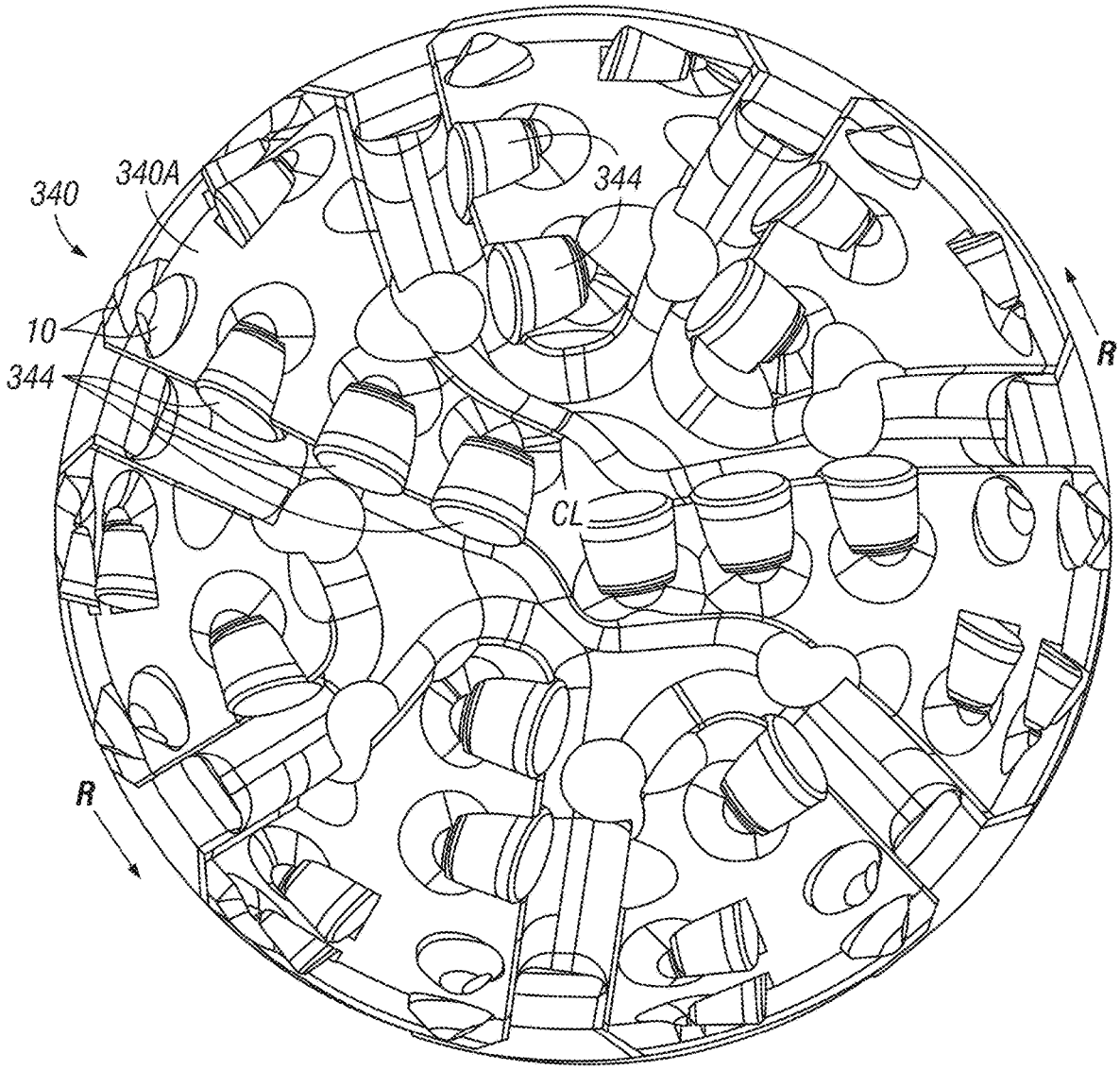
FIGS. 10 and 11 show views corresponding to FIGS. 4 and 5, respectively, of an example embodiment of a mill according to the present disclosure.
Figure 11:
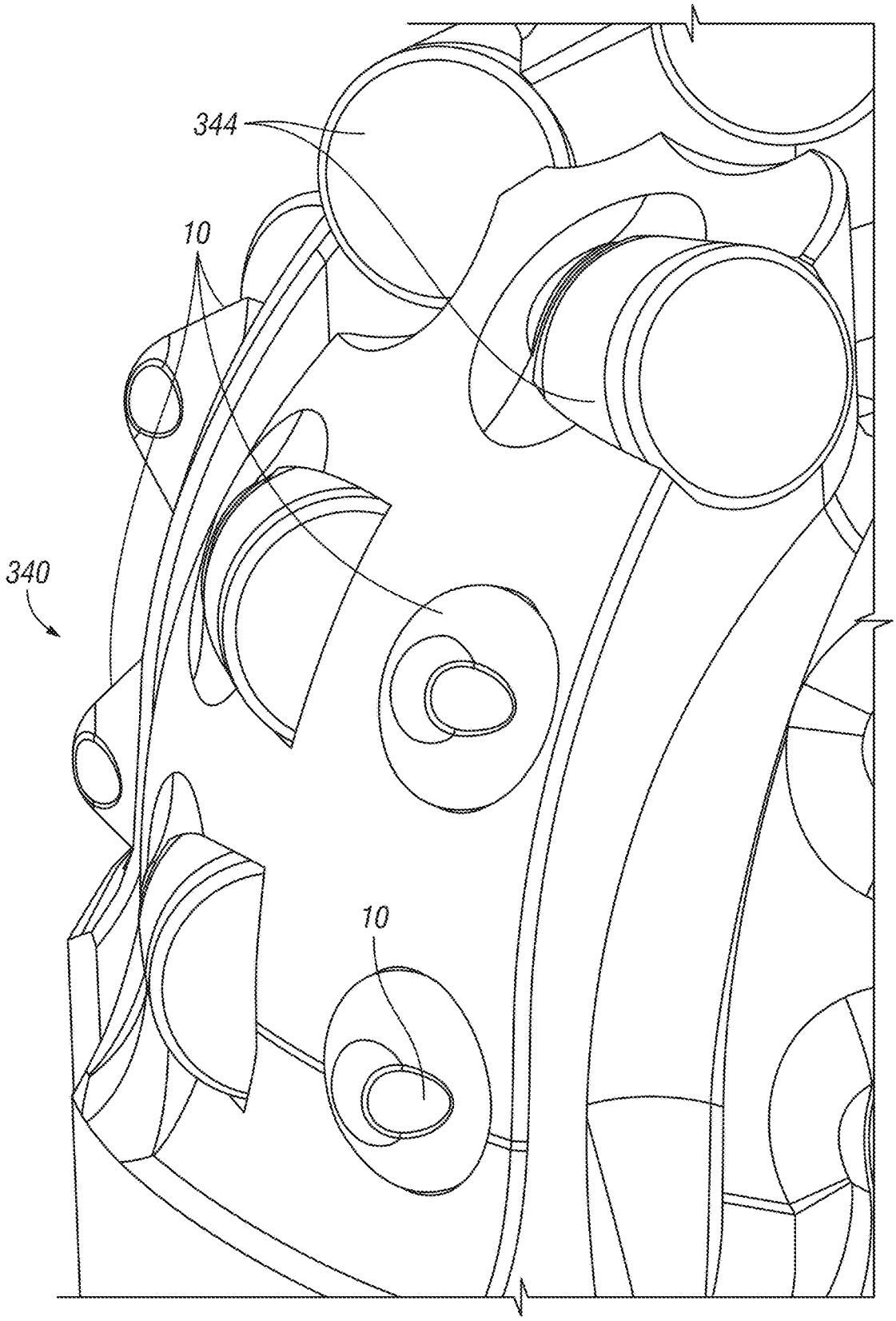

FIGS. 10 and 11 show corresponding views of an example embodiment of a mill 340 according to the present disclosure. The mill 340 may comprise a mill body 340A. Other cutters 344 such as shear cutters may be mounted to the bit body 340A in a selected pattern extending radially outwardly from the center or rotation CL of the bit body 340A. Combination cutters 10, configured as explained with reference to FIGS. 1 through 3, may be mounted toward the gage part of the mill body 340A as shown. The combination cutters 10 may be oriented such that their planes of symmetry (P in FIG. 7) are within a range of the direction of motion R plus 90 degrees and the direction of rotation R minus 90 degrees, as explained above.

Figure 12:
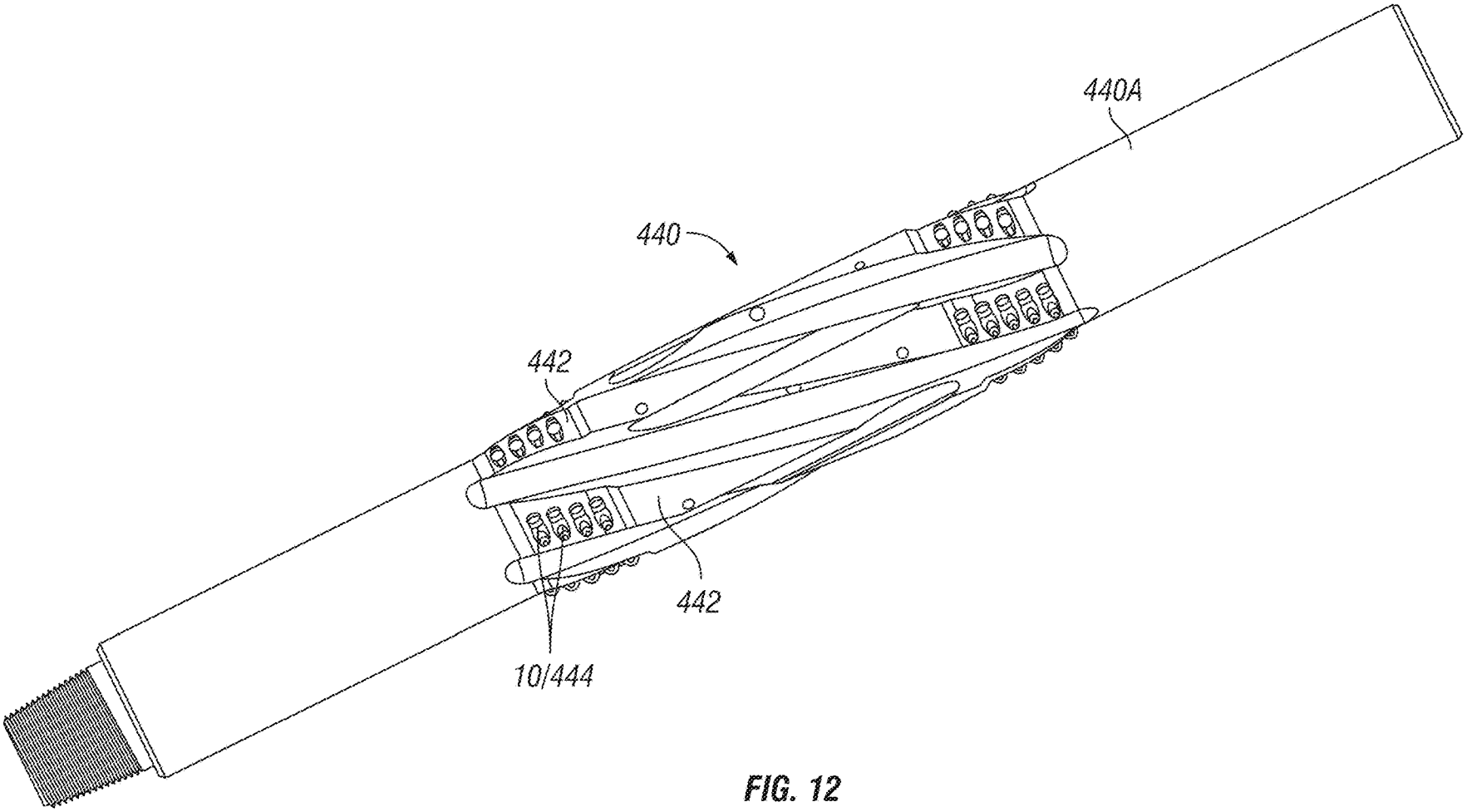
FIGS. 12 and 13 show views corresponding to FIGS. 4 and 5, respectively, of an example embodiment of a reamer according to the present disclosure.
Figure 13:
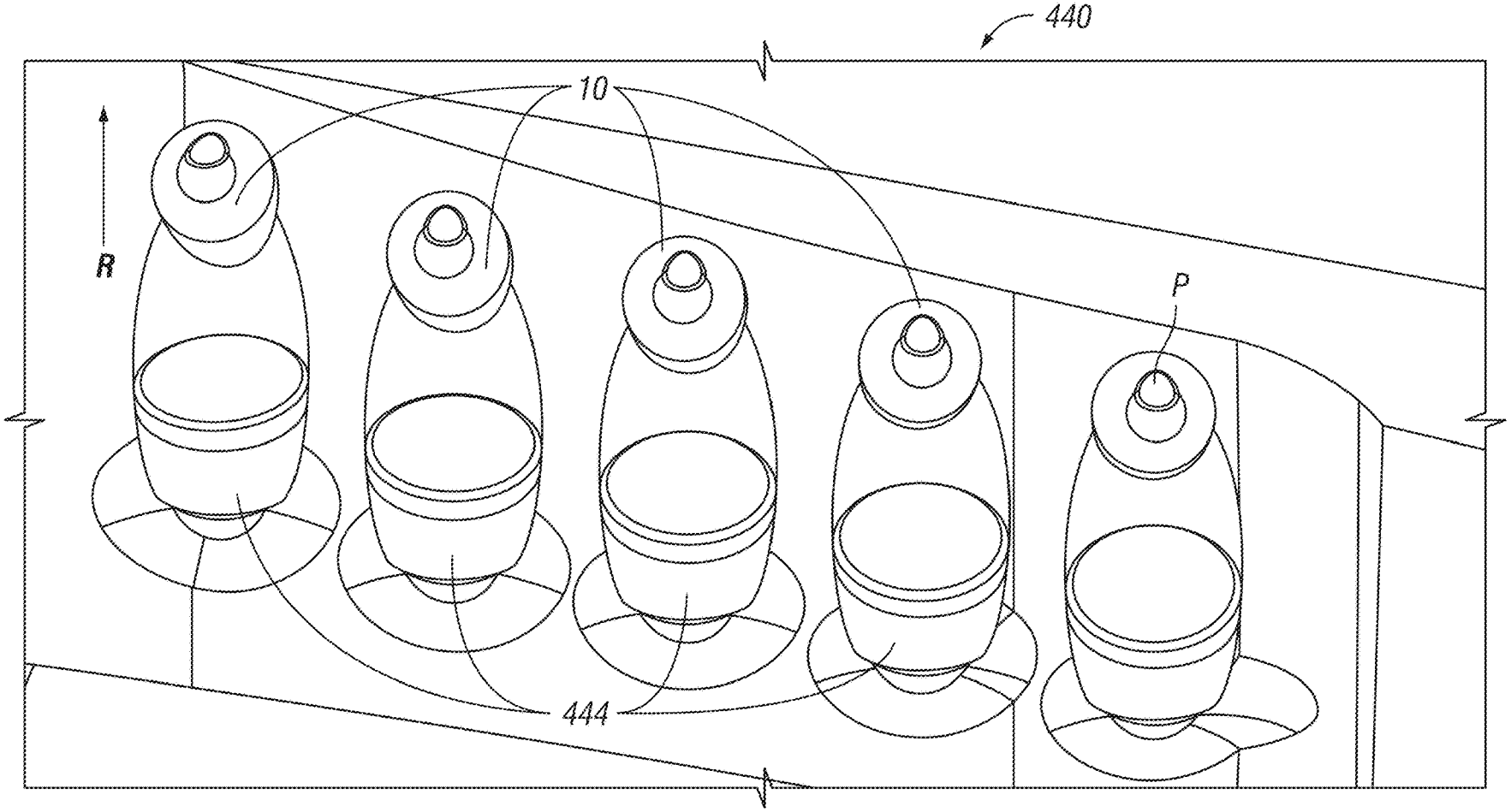

FIGS. 12 and 13 show an oblique side view and an enlarged view, respectively, of a reaming tool ("reamer") 440 according to the present disclosure. The reamer 440 may comprise a reamer body 440A having features, e.g., threaded connectors, to couple the reamer body 440A within a drill string or other well tool string for reaming operations. The reamer body 440A may comprise one or more blades 442, onto which are mounted cutters 10/444 to include combination cutters 10 as explained above, and other cutters 444, which may be any combination so shear cutters, gouging cutters, pick cutters and the like. The combination cutters 10 may be mounted rotationally leading or ahead of the other cutters 444, either at corresponding longitudinal positions along the reamer body 440A or at different longitudinal positions. In some embodiments, the planes of symmetry P of the combination cutters 10 may be oriented within a range of the direction of rotation R minus 90 degrees and the direction of rotation R plus 90 degrees in a similar manner as explained with reference to other embodiments of well construction tools described herein.

Figure 14:
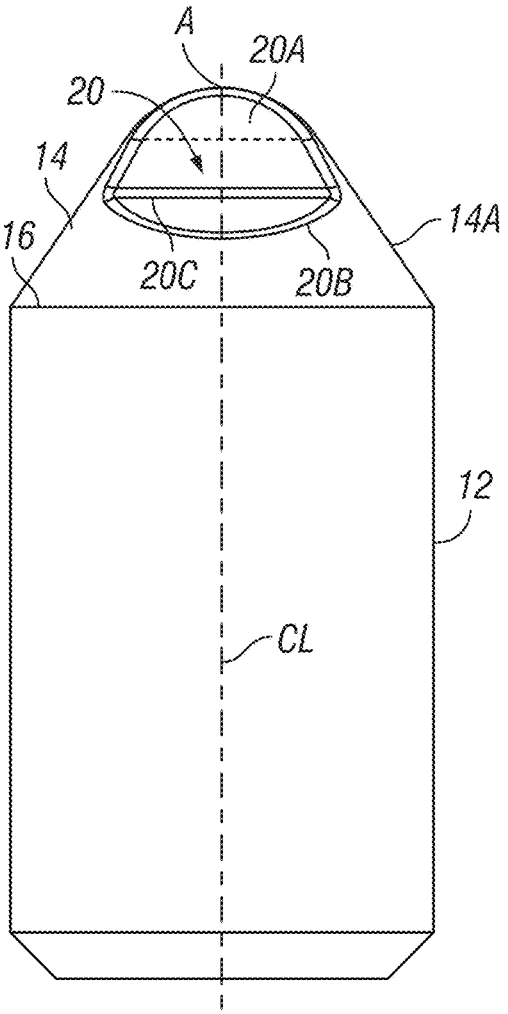
FIGS. 14 and 15 show another example embodiment of a cutter corresponding to the views thereof as in FIGS. 1 and 2, respectively.
Figure 15:
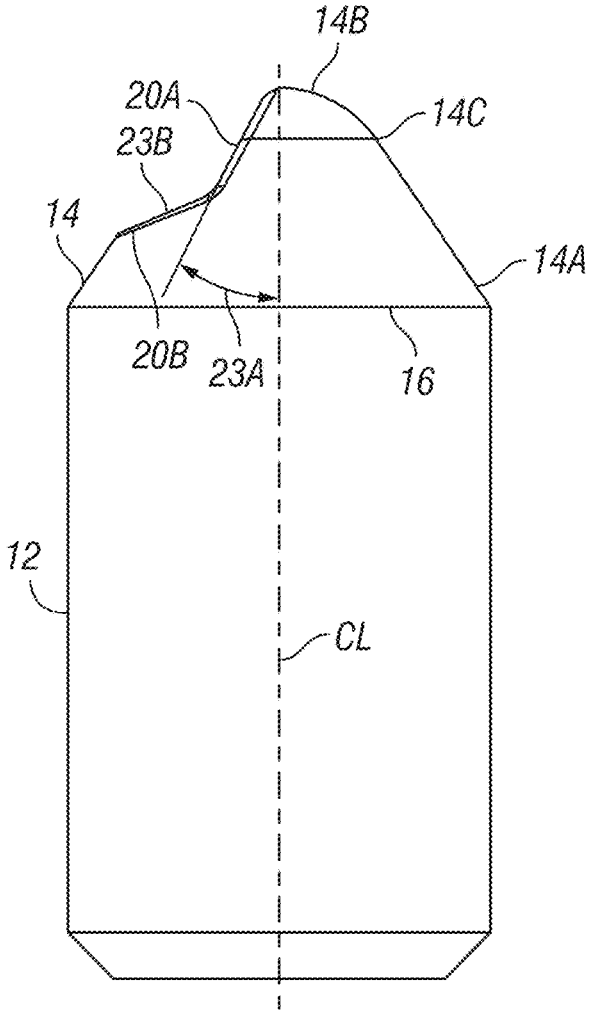

FIGS. 14 and 15 show front and side views, respectively, of another example embodiment of a combination cutter 10A corresponding to the views thereof as shown in FIGS. 1 and 2. The example embodiment in FIGS. 14 and 15 may be used in any of the embodiments of well construction tool and in the same manner in which the embodiment of FIGS. 1 and 2 have been explained elsewhere herein.

In the present example embodiment, the shear cutting surface 20 may comprise a first planar subsurface 20A which intersects the cutting structure 14 proximate the tip 14B. The shear cutting surface 20 may further comprise a second planar subsurface 20B that intersects the cutting structure 14 proximate the interface 16. The first planar subsurface 20A may subtend an angle 23A with respect to the reference H, in this case the orientation of the interface 16, that is greater than an angle 23B subtended by the second planar subsurface 20B with respect to the reference H. Intersection of the first planar subsurface 20A and the second planar subsurface 20B may occur along a line 20C intermediate the intersection of the first planar subsurface 20A with the cutting structure 14 and the intersection of the second planar surface 20B with the cutting structure 14. Other features of the cutter 10A may be the same as corresponding features of the cutter shown at 10 in FIGS. 1 and 2.

Figure 16:
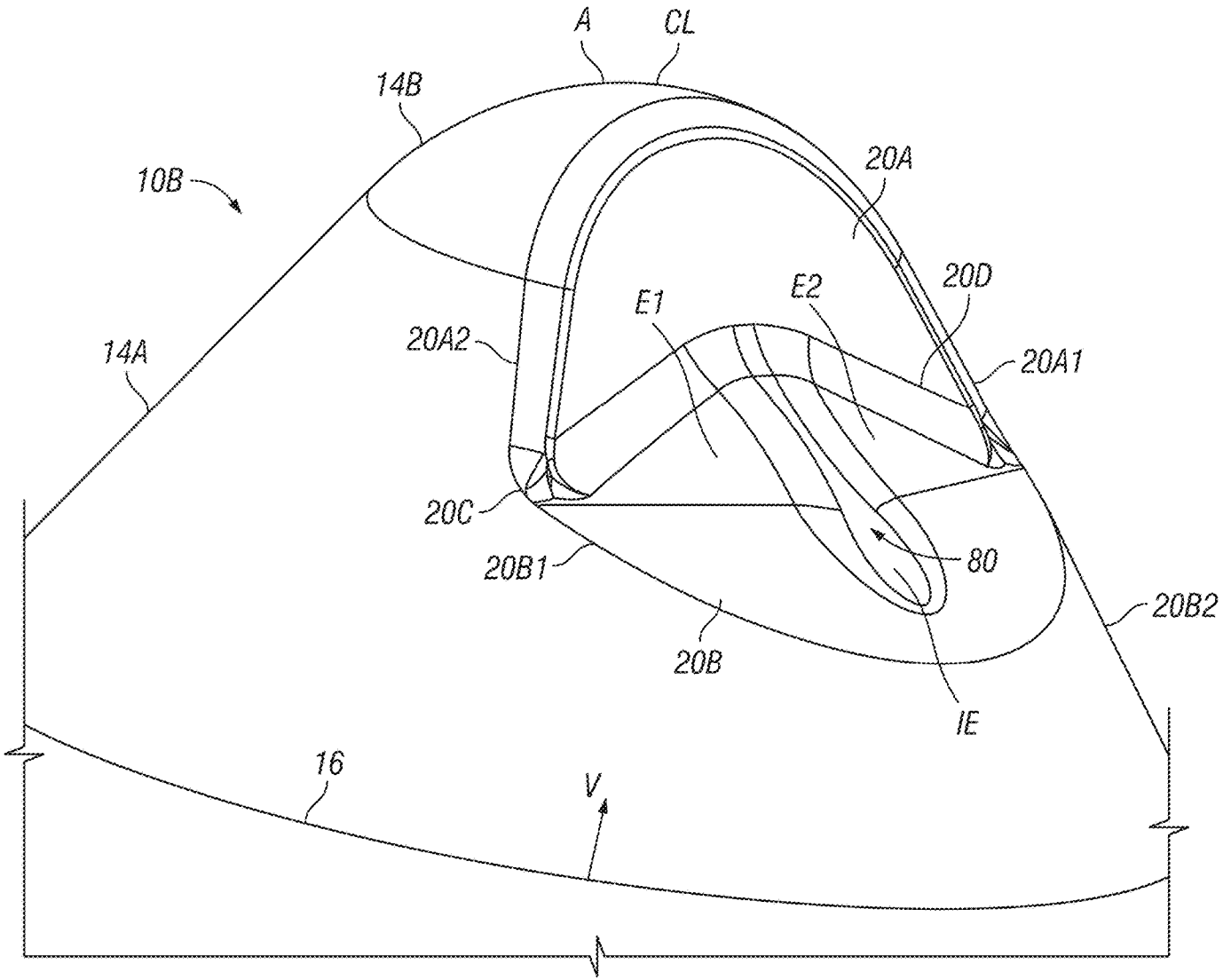
FIGS. 16 and 17 show another example embodiment of a cutter according to FIGS. 16 and 17, further comprising a chip breaker feature.
Figure 17:
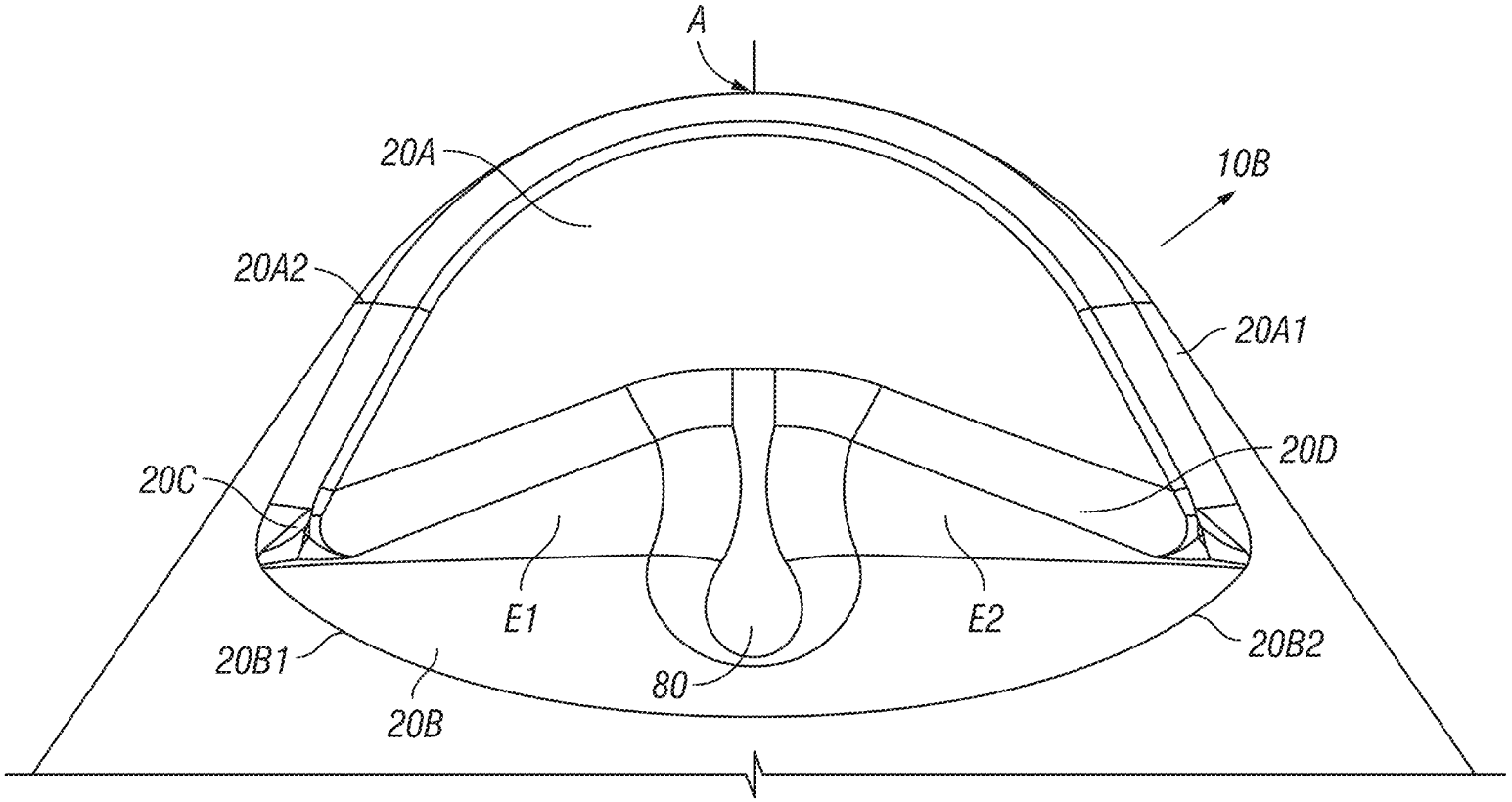

In some embodiments, the cutter 10A shown in FIGS. 14 and 15 may include a "chip breaker" feature. Referring to FIGS. 16 and 17, the chip breaker feature 80 may be proximate to and may straddle the line 20C,. The cutter 10B shown in FIGS. 16 and 17 may have all the structural elements and features of the cutter shown at 10A in and explained with reference to FIGS. 14 and 15, including, in the cutting structure 14, shown as its components the flank 14A and the tip 14B, the first planar subsurface 20A and second planar subsurface 20B.

Intersections of the first planar subsurface 20A with the cutting structure 14 laterally, that is, in a direction transverse to the centerline CL may be defined as a first lateral intersection 20A1 and a second lateral intersection 20A2. Intersection of the second planar subsurface 20B laterally may be defined as a third lateral intersection 20B1 and a fourth lateral intersection 20B2. Intersection of the first planar subsurface 20A and the second planar subsurface 20B may occur on a curve 20D having a shape related to the shape of the chip breaker feature 80. Although referred to as a "chip breaker" herein, the foregoing chip breaker feature 80 may be more broadly described as a tapered structure on the shear cutting surface 20 that assists in breaking cuttings from the well construction tool into smaller fragments than when initially cut, and separating the fragments in space to as to reduce the possibility of "balling" or aggregation of cuttings fragments as they are moved away from the well construction tool. The chip breaker feature 80 extends outwardly, that is at least in part in a direction normal to the first planar subsurface 20A and normal to the second planar subsurface 20B. Intersection of the chip breaker feature 80 with the first planar subsurface 20A may take place at a location at or proximate to the intersection of the first planar subsurface 20A with the cutting structure 14 proximate the apex A, or intermediate such intersection and the location of the line 20C. The location of the line 20C, as explained above with reference to FIGS. 14 and 15, represents intersection of the first planar subsurface 20A and the second planar subsurface 20B absent the chip breaker feature 80. Correspondingly, the chip breaker feature 80 may intersect the second planar subsurface 20B at or proximate to, the intersection of the second planar subsurface 20B with the part of the cutting structure 14 proximate the interface 16, or such intersection may be intermediate the intersection of the second planar subsurface 20B and the cutting structure 14 (proximate the interface 16) and the location of the line 20C.

The chip breaker feature 80 may be generally described as increasing its outward extension (as defined above), in some embodiments monotonically, with respect to distance from the lateral intersections 20A1, 20A2 of the first planar subsurface 20A and distance from the lateral intersections 20B1, 20B2 of the second planar subsurface 20B. Such increase in distance may define a first lateral subfeature E1 and a second lateral subfeature E2 on opposed sides of an intersection feature IE, which may be a point, a line or a curve depending on the shape of the lateral subfeatures E1, E2. The intersection feature IE represents, as stated, the intersection of the first and second lateral subfeatures E1, E2. The intersection feature IE in some embodiments when the intersection feature IE defines other than a point, e.g., a line or a curve, may define a maximum radius of curvature so as to apply high shear pressure to incoming cuttings. Such high shear pressure may increase efficiency of the chip breaker feature, while minimizing tendency of the intersection feature IE to fail during well construction operations. Lateral position of the intersection feature IE may be approximately mid way between the lateral intersections 20A1, 20A 2 and 20B1, 20B2 as shown in FIG. 16 and FIG. 17, however the lateral position of the intersection feature IE relative to the foregoing intersections is not a limit on the scope of the present disclosure.

Figure 18:
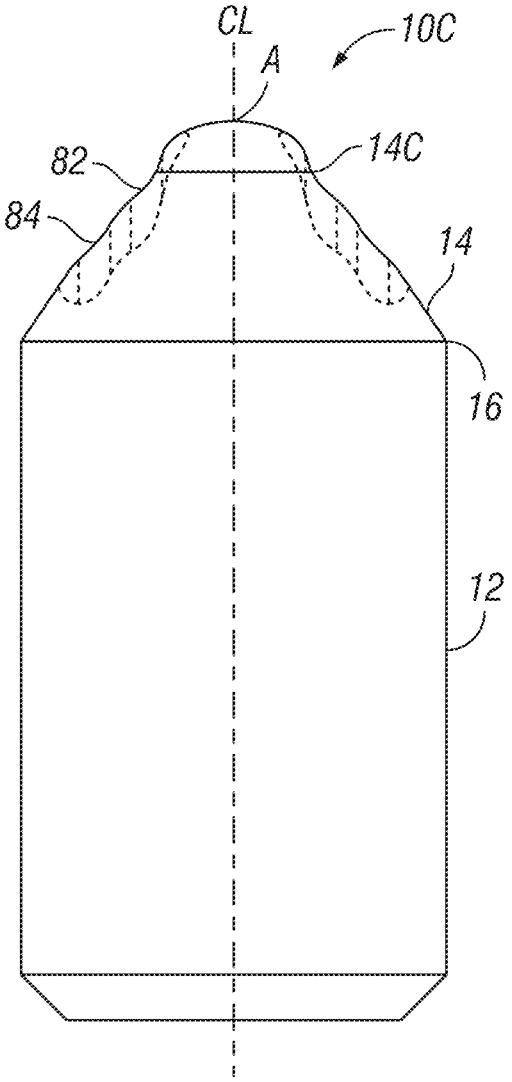
FIGS. 18 and 19 show side views in orthogonal directions of another example embodiment of a cutter according to the present disclosure including flow channels in a flank of the cutting structure.
Figure 19:
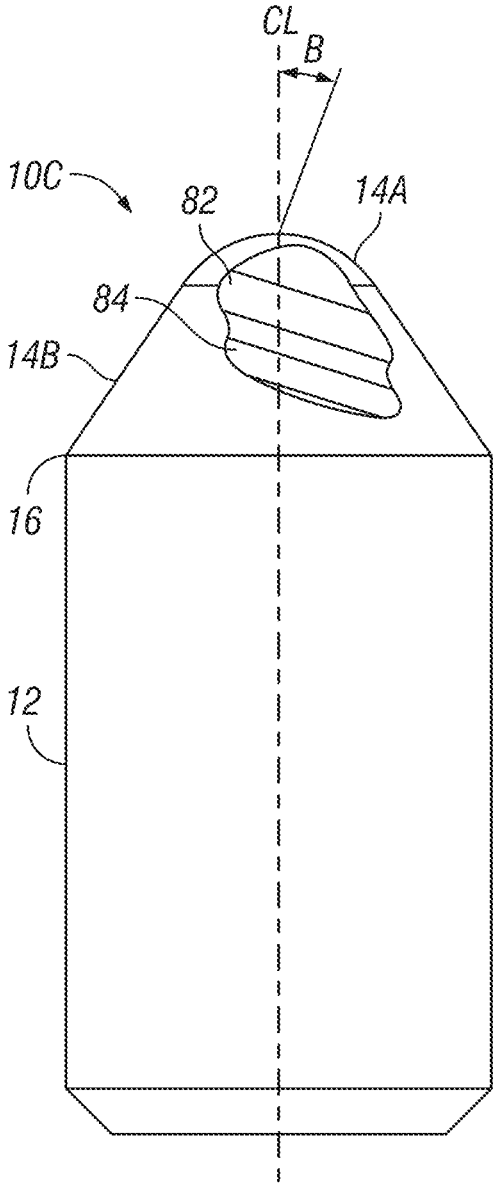

FIGS. 18 and 19 show side views in orthogonal directions of another example embodiment of a cutter according to the present disclosure. The cutter 10C may comprise a substrate 12 made from materials and having shape and dimensions as explained with reference to previous embodiments, e.g., a cylindrically shaped, metal carbide substrate. A cutting structure 14 may be attached to the substrate 12 across an interface 16. The cutting structure 14, as in other embodiments, may be super hard material such as polycrystalline diamond, cubic boron nitride or other super hard material known in the art for use in connection with well drilling bits. A flank 14A of the cutting structure 14 may be substantially conically shaped. A tip 14B of the cutting structure 14 may define a selected radius of curvature and extend from a boundary 14C with the flank 14A to an apex A in the center of the tip 14B. The apex A may in some embodiments define a maximum radius of curvature (AR in FIG. 1) as explained with reference to other embodiments herein, namely, that the radius of curvature is at most 75% of the diameter (D in FIG. 1) of the substrate 12. In some embodiments, the radius of curvature (AR in FIG. 1) may be at most 50% of the diameter (D in FIG. 1) of the substrate 12. In some embodiments, the radius of curvature (AR in FIG. 1) may be at most 25% of the diameter (D in FIG. 1) of the substrate 12.

In the present embodiment, at least one, and preferably two, substantially cylindrical flow channels 82, 84 may be milled, cut or otherwise formed in the sides of the cutting structure 14 to have the following properties. The flow channels 82, 84 may be parallel to each other and may be oriented at a selected angle B with reference to the centerline CL of the cutter 10C. The angle B as will be further explained, may be oblique, and may be related to the angle subtended by the centerline CL with reference to a center line or axis of rotation of a well construction tool (e.g., bits, reamers and mills as explained with reference to FIGS. 4 through 13). The flow channels 82, 84 may have a radius of curvature and a cut depth within the sides of the cutting structure 14 such that a length of the flow channels 82, 84 is shorter than the diameter of the cutting structure 14, that is, the diameter defined by the flanks of the cutting structure, at any longitudinal position along the center line CL between the interface 16 and the apex A. Further, the lateral edge of the flow channels 82, 84 disposed closest to the apex A, and the lateral edge closest to the interface 16 do not intersect the interface 16 or the apex A, as illustrated in FIG. 19.

Figure 20:
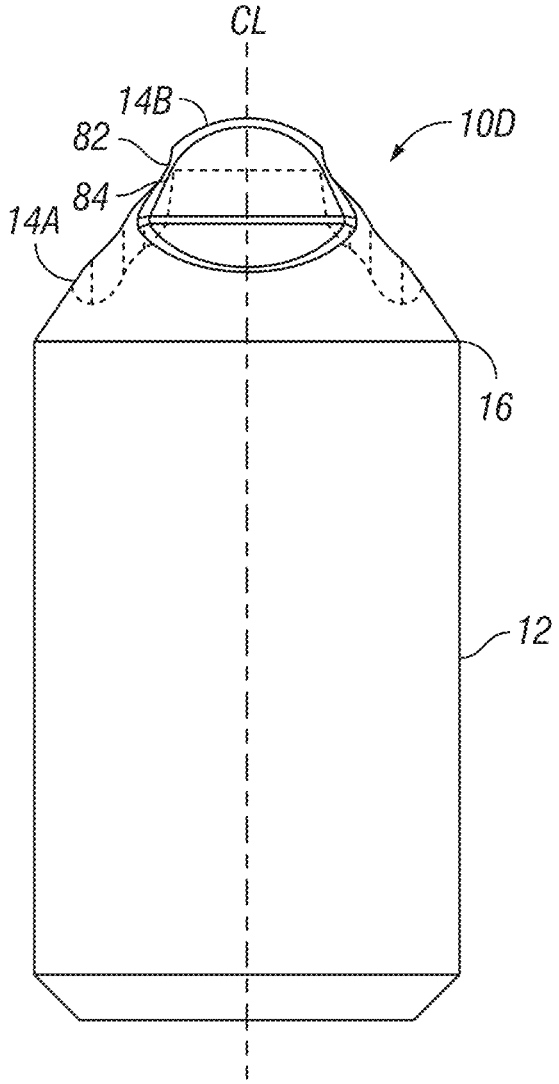
FIGS. 20 and 21 show side views of another example embodiment of a cutter according to the present disclosure.
Figure 21:
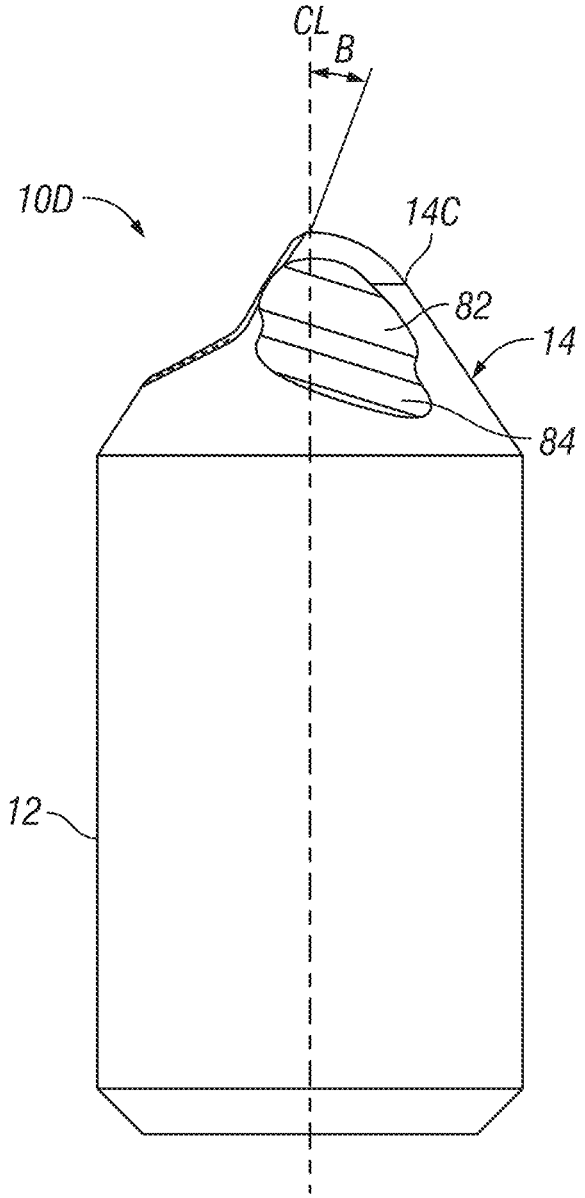

FIGS. 20 and 21 show corresponding views of another example embodiment of a cutter according to the present disclosure having flow channels substantially as explained with reference to FIGS. 18 and 19. The example cutter 10D in FIGS. 20 and 21 comprises a shear surface such as explained with reference to FIGS. 1 and 2, numeral 20, or FIGS. 14 and 15, numerals 20A and 20B.

Figure 22:
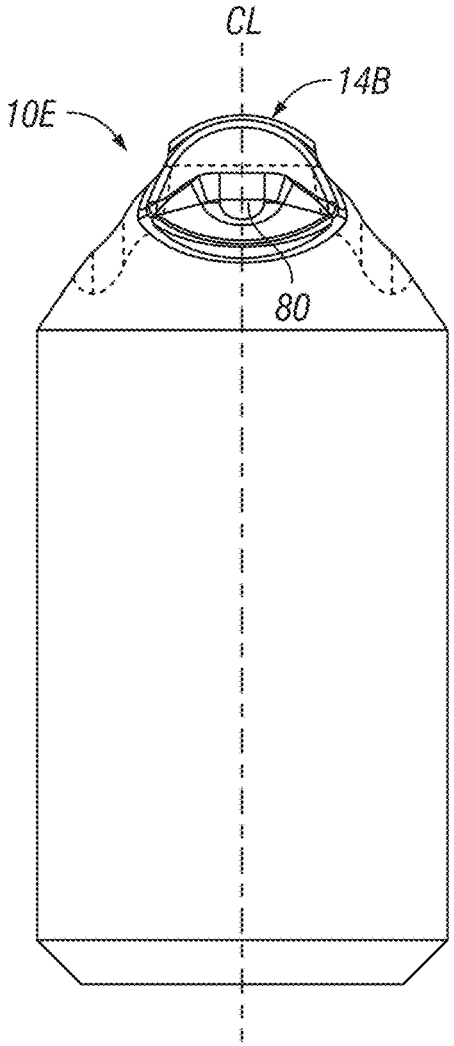
FIGS. 22 and 23 show side views of another example embodiment of a cutter according to the present disclosure.
Figure 23:
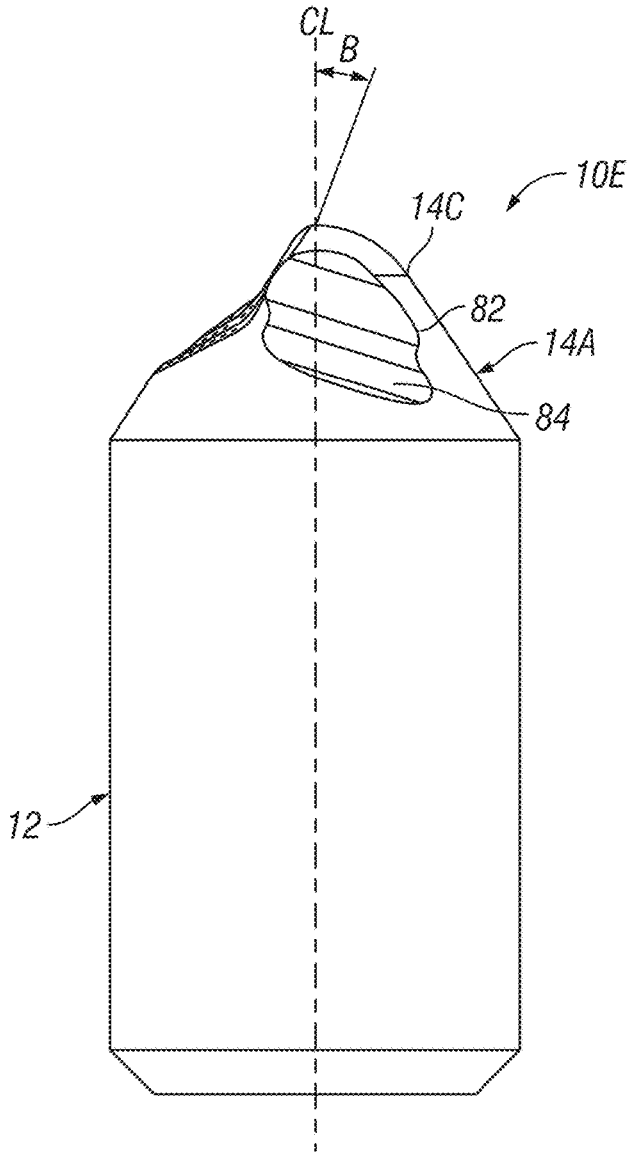

FIGS. 22 and 23 show corresponding views of another example embodiment of a cutter according to the present disclosure having flow channels substantially as explained with reference to FIGS. 18 and 19, and in addition having a chip breaker feature 80, which may be substantially as explained with reference to FIGS. 16 and 17.

In some embodiments of a cutter having flow channels as explained with reference to FIGS. 18 through 23, the flow channels 82, 84 may be disposed symmetrically on opposed sides of the apex A, and may be parallel between opposed sides, that is, a distance between corresponding longitudinal ends of each flow channel 82 or 84 is the same on opposed sides of the apex A. As will be further explained with reference to FIG. 24, the flow channels 82, 84 on opposed flanks of the cutting structure 14 may define a plane of symmetry (SP in FIG. 24).

Cutters as explained with reference to FIGS. 18 through 23 may be used in any or all cutter positions on a well construction tool as explained with reference to FIGS. 4 through 13.

Figure 24:
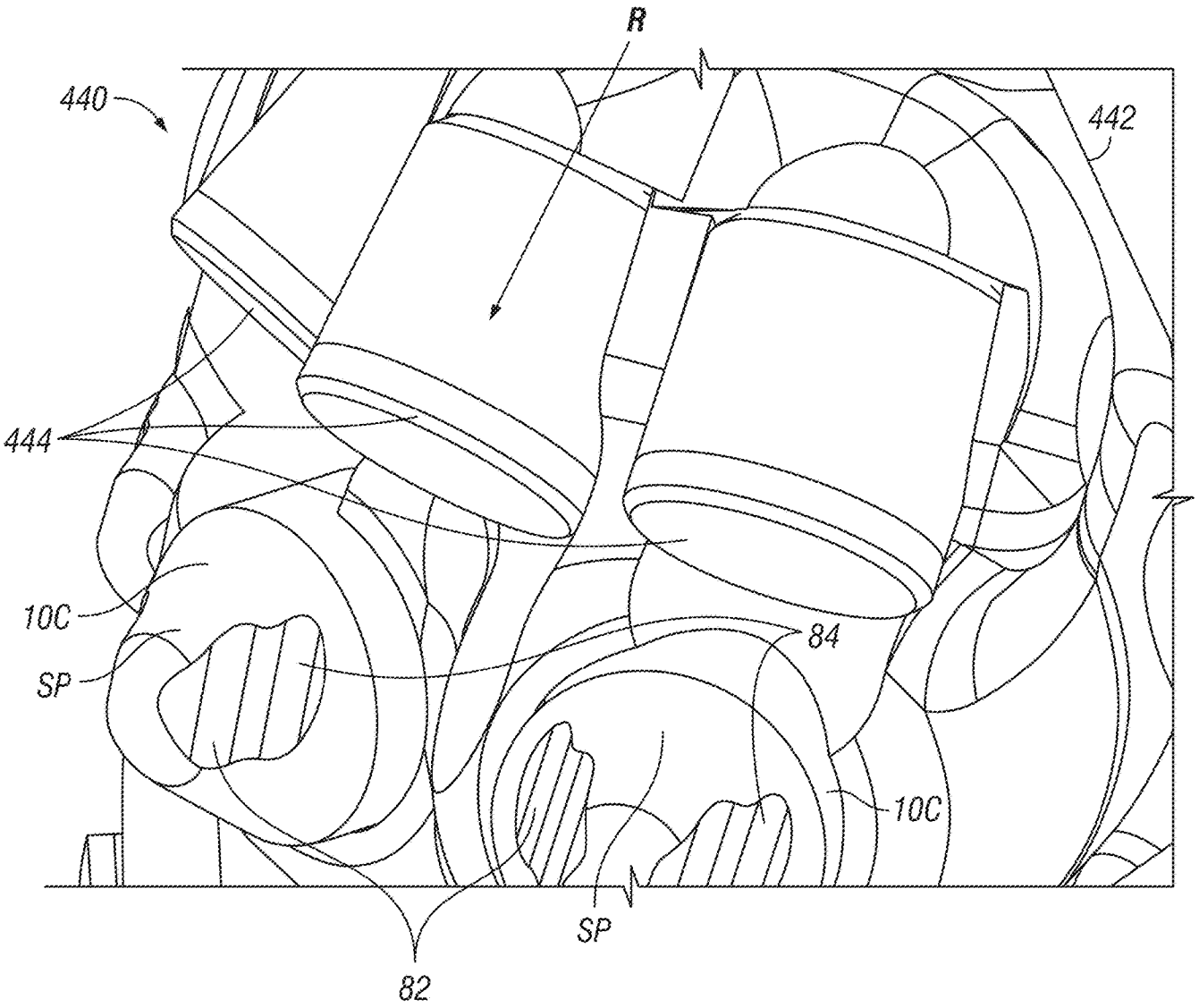
FIG. 24 shows an example embodiment of a well construction tool using cutters as explained with reference to FIGS. 18 and 19.

An example embodiment of a well construction tool using cutters as explained with reference to FIGS. 18 through 23 may be observed in FIG. 24. The well construction tool 440 may comprise a tool body 442, as explained with reference to any or all of FIGS. 4 through 13. Cutters, e.g., shear cutters 444 may be attached to the tool body 442 at selected locations, e.g., in rows on one or more blades, although the configuration shown in FIG. 24 is not intended to limit the scope of the present disclosure.

One or more gouging cutters 10C, which may be made as explained with reference to FIGS. 18 and 19 in the present example embodiment, may be affixed to the tool body 442 in selected locations. In the present example embodiment, a plane of symmetry SP of each such gouging cutter 10C may be oriented to be parallel to the direction of rotation R of the well construction tool 440 during use.

While the embodiment shown in FIG. 24 includes cutters as explained with reference to FIGS. 18 and 19, it should be understood that cutters made as explained with reference to FIGS. 20 and 21, and/or with reference to FIGS. 22 and 23 may be affixed to a well construction tool in any form or arrangement explained herein.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A cutter for a well construction tool, comprising:

a cutting structure affixed to a substrate, the substrate made from metal carbide or steel covered with metal carbide, the cutting structure made from polycrystalline diamond, (PCD), diamond monolith, cubic boron nitride (CBN), diamond impregnated carbide, or diamond impregnated alloy, the cutting structure defining a monotonically decreasing diameter with respect to an axial distance from an interface between the cutting structure and the substrate; and a shear surface formed in the cutting structure, the shear surface intersecting a surface of the cutting structure between the interface and an apex of the cutting structure, the shear surface defining a smaller angle with respect to a centerline of the cutter than the cutting structure proximate the interface, the shear surface defining a larger angle with respect to the centerline of the cutter than the cutting structure proximate the apex;

wherein the apex is rotationally symmetric about a centerline of the cutting structure in all rotational directions; and wherein a radius of curvature of the apex is at most 75 percent of a diameter of the substrate.

2. The cutter of claim 1 wherein the radius of curvature of the apex is at most 50 percent of a diameter of the substrate.

3. The cutter of claim 1 wherein the radius of curvature is at most 25 percent of a diameter of the substrate.

4. The cutter of claim 1 wherein the shear surface comprises a first planar subsurface intersecting the cutting structure proximate the apex, the first planar subsurface oriented at the larger angle, the shear surface comprising a second planar subsurface intersecting the cutting structure proximate the interface, the second planar subsurface oriented at the smaller angle.

5. The cutter of claim 4 further comprising a chip breaker feature disposed intermediate intersection of the first planar subsurface with the cutting structure and intersection of the second planar subsurface with the cutting structure, the chip breaker feature disposed intermediate lateral intersections of the first planar subsurface with the cutting structure and lateral intersections of the second planar subsurface with the cutting structure, the chip breaker feature extending outwardly from the first planar subsurface and the second planar subsurface.

6. The cutter of claim 5 wherein an amount of outward extension of the chip breaker feature is related to a distance away from the lateral intersection of the first planar subsurface and the second planar subsurface on one side of a laterally intermediate point on the chip breaker feature and a distance away from the lateral intersection of the first planar subsurface and the second planar subsurface on an opposed side of the intermediate point.

7. The cutter of claim 6 wherein the intermediate point is disposed mid way between the lateral intersections of the first planar subsurface with the cutting structure and lateral intersections of the second planar subsurface with the cutting structure.

8. The cutter of claim 1 further comprising at least one flow channel formed in the cutting structure between the apex and the interface on opposed lateral flanks of the cutting structure, the at least one flow channel having a radius of curvature and depth of cut so as to intersect each lateral flank at less than a full diameter of the cutting structure at a respective longitudinal position along a centerline of the cutting structure.

9. The cutter of claim 8 wherein the at least one flow channel on the opposed lateral flanks subtends an oblique angle with respect to the centerline.

10. The cutter of claim 9 wherein the subtended angle corresponds to an angle subtended between the centerline and an axis of rotation of a tool body to which the cutter is attached.

11. The cutter of claim 8 wherein the shear surface comprises a first planar subsurface intersecting the cutting structure proximate the apex, the first planar subsurface oriented at the larger angle, the shear surface comprising a second planar subsurface intersecting the cutting structure proximate the interface, the second planar subsurface oriented at the smaller angle, the shear surface further comprising a chip breaker feature intermediate intersection of the first planar subsurface with the cutting structure and intersection of the second planar subsurface with the cutting structure, the chip breaker feature disposed intermediate a lateral intersection of the first planar subsurface with the cutting structure and a lateral intersections of the second planar subsurface with the cutting structure, the chip breaker feature extending outwardly from the first planar subsurface and the second planar subsurface.

12. The cutter of claim 11 wherein an amount of outward extension of the chip breaker feature is related to a distance away from the lateral intersections of the first planar subsurface and the second planar subsurface on one side of a laterally intermediate point in the chip breaker feature and a distance away from the lateral intersections of the first planar subsurface and the second planar subsurface on an opposed side of the intermediate point.

13. The cutter of claim 12 wherein the intermediate point is mid way between opposed lateral intersections of the first planar subsurface and the second planar subsurface.

14. A well construction tool, comprising:

a tool body; and a plurality of cutters attached to the tool body, at least one of the plurality of cutters comprising a cutting structure affixed to a substrate, the substrate made from metal carbide or steel covered with metal carbide, the cutting structure made from polycrystalline diamond, (PCD), diamond monolith, cubic boron nitride (CBN), diamond impregnated carbide, or diamond impregnated alloy, the cutting structure defining a monotonically decreasing diameter with respect to an axial distance from an interface between the cutting structure and the substrate, and a shear surface formed in the cutting structure, the shear surface intersecting a surface of the cutting structure between the interface and an apex of the cutting structure, the shear surface defining a smaller angle with respect to a centerline of the at least one cutter than the cutting structure proximate the interface, the shear surface defining a larger angle with respect to the centerline than the cutting structure proximate the apex, wherein the apex is rotationally symmetric about a centerline of the cutting structure in all rotational directions, and wherein a radius of curvature of the apex is at most 75 percent of a diameter of the substrate.

15. The well construction tool of claim 14 wherein the tool body comprises one of a drill bit body, a reaming tool body and a mill body.

16. The well construction tool of claim 14 wherein the radius of curvature of the apex is at most 50 percent of a diameter of the substrate.

17. The well construction tool of claim 14 wherein the radius of curvature is at most 25 percent of a diameter of the substrate.

18. The well construction tool of claim 14 wherein at least a second one of the plurality of cutters comprises a shear cutter.

19. The well construction tool of claim 14 wherein the at least one of the plurality of cutters is mounted to a post formed in the tool body.

20. The well construction tool of claim 14 wherein the at least one of the plurality of cutters is mounted to a blade formed in the tool body.

21. The well construction tool of claim 14 wherein the shear surface comprises a first planar subsurface intersecting the cutting structure proximate the apex, the first planar subsurface oriented at the larger angle, the shear surface comprising a second planar subsurface intersecting the cutting structure proximate the interface, the second planar subsurface oriented at the smaller angle.

22. The well construction tool of claim 14 further comprising a chip breaker feature intermediate intersection of the first planar subsurface with the cutting structure and intersection of the second planar subsurface with the cutting structure, the chip breaker feature disposed intermediate lateral intersections of the first planar subsurface with the cutting structure and intermediate lateral intersections of the second planar subsurface with the cutting structure, the chip breaker feature extending outwardly from the first planar subsurface and the second planar subsurface.

23. The well construction tool of claim 22 wherein an amount of outward extension of the chip breaker feature is related to a distance away from the lateral intersection of the first planar subsurface and the second planar subsurface on one side of a laterally intermediate point on the chip breaker feature and a distance away from the lateral intersection of the first planar subsurface and the second planar subsurface on an opposed side of the laterally intermediate point.

24. The well construction tool of claim 23 wherein the intermediate point is mid way between opposed lateral intersections of the first planar subsurface and the second planar subsurface.

25. The well construction tool of claim 14 further comprising at least one flow channel formed in the cutting structure between the apex and the interface on opposed lateral flanks of the cutting structure, the at least one flow channel having a radius of curvature and depth of cut so as to intersect each lateral flank at less than a full diameter of the cutting structure at a respective longitudinal position along a centerline of the cutting structure.

26. The well construction tool of claim 25 wherein the at least one flow channel on the opposed lateral flanks subtends an oblique angle with respect to the centerline.

27. The well construction tool of claim 26 wherein the subtended angle corresponds to an angle subtended between the centerline and an axis of rotation of a tool body to which the cutter is attached.

28. The well construction tool of claim 25 wherein the shear surface comprises a first planar subsurface intersecting the cutting structure proximate the apex, the first planar subsurface oriented at the larger angle, the shear surface comprising a second planar subsurface intersecting the cutting structure proximate the interface, the second planar subsurface oriented at the smaller angle, the cutter further comprising a chip breaker feature intermediate intersection of the first planar subsurface with the cutting structure and intersection of the second planar subsurface with the cutting structure, the chip breaker feature disposed intermediate lateral intersections of the first planar subsurface with the cutting structure and intermediate lateral intersections of the second planar subsurface with the cutting structure, the chip breaker feature extending outwardly from the first planar subsurface and the second planar subsurface.

29. The well construction tool of claim 28 wherein an amount of outward extension of the chip breaker feature is related to a distance away from the lateral intersection of the first planar subsurface and the second planar subsurface on one side of a laterally intermediate point on the chip breaker feature and a distance away from the lateral intersection of the first planar subsurface and the second planar subsurface on an opposed side of the intermediate point.

30. The well construction tool of claim 29 wherein the intermediate point is mid way between opposed lateral intersections of the first planar subsurface and the second planar subsurface.

* * * * *